US008420283B2

(12) United States Patent
Fuchigami et al.

(10) Patent No.: US 8,420,283 B2
(45) Date of Patent: Apr. 16, 2013

(54) COATING LIQUID FOR FORMING UNDERCOAT LAYER, METHOD FOR PREPARING COATING LIQUID FOR FORMING UNDERCOAT LAYER, ELECTROPHOTOGRAPHIC PHOTORECEPTOR, IMAGE-FORMING APPARATUS, AND ELECTROPHOTOGRAPHIC CARTRIDGE

(75) Inventors: Hiroe Fuchigami, Odawara (JP); Kozo Ishio, Odawara (JP)

(73) Assignee: Mitsubishi Chemical Corporation, Tokyo (JP)

( * ) Notice: Subject to any disclaimer, the term of this patent is extended or adjusted under 35 U.S.C. 154(b) by 766 days.

(21) Appl. No.: 12/300,853

(22) PCT Filed: May 18, 2007

(86) PCT No.: PCT/JP2007/060221

§ 371 (c)(1), (2), (4) Date: Mar. 10, 2009

(87) PCT Pub. No.: WO2007/135986

PCT Pub. Date: Nov. 29, 2007

(65) Prior Publication Data

US 2009/0208249 A1 Aug. 20, 2009

(30) Foreign Application Priority Data

May 18, 2006 (JP) ..... 2006-139531

(51) Int. Cl.
*G03G 15/04* (2006.01)

(52) U.S. Cl.
USPC ..... 430/60; 430/63; 430/69; 430/108.6; 241/16; 241/172; 399/159

(58) Field of Classification Search ..... 430/60, 430/63, 69, 108.6; 241/16, 171, 172; 399/159
See application file for complete search history.

(56) References Cited

U.S. PATENT DOCUMENTS 5,391,448 A 2/1995 Katayama et al.
5,882,246 A * 3/1999 Inkyo et al. ..... 451/87

(Continued)

FOREIGN PATENT DOCUMENTS

JP 1 176433 7/1989
JP 6 202366 7/1994

(Continued)

OTHER PUBLICATIONS

U.S. Appl. No. 13/188,743, filed Jul. 22, 2011, Fuchigami.

(Continued)

*Primary Examiner* — Thorl Chea
(74) *Attorney, Agent, or Firm* — Oblon, Spivak, McClelland, Maier & Neustadt, L.L.P.

(57) ABSTRACT

Provided is a coating liquid for forming an undercoat layer of an electrophotographic photoreceptor exhibiting high stability. In the coating liquid for forming an undercoat layer of an electrophotographic photoreceptor containing metal oxide particles and a binder resin, the metal oxide particles have a cumulative volume average diameter D50 of 0.1 μm or less and a volume particle size distribution width index SD satisfying the following Expression (1) which are measured by a dynamic light-scattering method in the coating liquid for forming an undercoat layer, $$0.010 \leqq SD \leqq 0.040 \quad (1)$$

where SD=(D84−D16)/2, where D84 represents the particle diameter (μm) at a point of 84% in the cumulative volume particle size distribution curve, and D16 represents the particle diameter (μm) at a point of 16% in the cumulative volume particle size distribution curve.

16 Claims, 6 Drawing Sheets

U.S. PATENT DOCUMENTS

| | | | | |
|---|---|---|---|---|
| 5,932,385 | A * | 8/1999 | Takamura et al. | 430/63 |
| 7,366,448 | B2 | 4/2008 | Taniguchi et al. | |
| 7,378,153 | B2 | 5/2008 | Yamamoto et al. | |
| 2006/0062592 | A1 * | 3/2006 | Taguchi | 399/111 |
| 2006/0088778 | A1 | 4/2006 | Itami et al. | |

FOREIGN PATENT DOCUMENTS

| | | |
|---|---|---|
| JP | 6 273962 | 9/1994 |
| JP | 7 271078 | 10/1995 |
| JP | 9-96916 | 4/1997 |
| JP | 10 69116 | 3/1998 |
| JP | 10 260545 | 9/1998 |
| JP | 11 503666 | 3/1999 |
| JP | 11 202519 | 7/1999 |
| JP | 2000 242016 | 9/2000 |
| JP | 2000 258939 | 9/2000 |
| JP | 2001 290292 | 10/2001 |
| JP | 2002 311626 | 10/2002 |
| JP | 2003 84472 | 3/2003 |
| JP | 2004 78140 | 3/2004 |
| JP | 2004 233465 | 8/2004 |
| JP | 2004 233678 | 8/2004 |
| JP | 2005 181467 | 7/2005 |
| JP | 2005 292782 | 10/2005 |
| JP | 2005 331881 | 12/2005 |
| JP | 2005 338445 | 12/2005 |
| JP | 2006-72318 A | 3/2006 |
| JP | 2006 154753 | 6/2006 |
| TW | I242580 | 11/2005 |
| WO | 96 39251 | 12/1996 |
| WO | 2006 054397 | 5/2006 |

OTHER PUBLICATIONS

Korean Office Action mailed on Oct. 28, 2010 in corresponding Korean Application No. 2008-7025105 (with English Translation).

U.S. Appl. No. 12/612,982, filed Nov. 5, 2009, Fuchigami.

U.S. Appl. No. 12/613,023, filed Nov. 5, 2009, Fuchigami.

Japanese Office Action issued Apr. 3, 2012 (with English translation) in connection with Japanese Patent Application No. 2007-133453, filed Dec. 27, 2007.

U.S. Appl. No. 12/301,121, filed Nov. 17, 2008, Mitsumori, et al.

U.S. Appl. No. 12/300,943, filed Nov. 14, 2008, Mitsumori, et al.

U.S. Appl. No. 12/301,088, filed Nov. 17, 2008, Mitsumori, et al.

U.S. Appl. No. 12/301,109, filed Nov. 17, 2008, Mitsumori, et al.

U.S. Appl. No. 12/301,376, filed Nov. 18, 2008, Mitsumori, et al.

U.S. Appl. No. 12/301,361, filed Nov. 18, 2008, Mitsumori, et al.

Taiwanese Office issued Jan. 21, 2013 in connection with corresponding Taiwanese Application No. 096117803, filed May 18, 2007.

* cited by examiner

COATING LIQUID FOR FORMING UNDERCOAT LAYER, METHOD FOR PREPARING COATING LIQUID FOR FORMING UNDERCOAT LAYER, ELECTROPHOTOGRAPHIC PHOTORECEPTOR, IMAGE-FORMING APPARATUS, AND ELECTROPHOTOGRAPHIC CARTRIDGE

TECHNICAL FIELD

The present invention relates to a coating liquid for forming an undercoat layer used for forming an undercoat layer of an electrophotographic photoreceptor by applying and drying the liquid, a method for preparing the liquid, and an electrophotographic photoreceptor, an image-forming apparatus, and an electrophotographic cartridge whose undercoat layers are formed with the coating liquid for forming an undercoat layer.

BACKGROUND ART

Recently, electrophotographic technology has been widely applied to a variety of printers, as well as the field of copiers, due to its immediacy and formation of high-quality images. Electrophotographic photoreceptors (hereinafter, referred to as "photoreceptor" simply) lie in the core technology of electrophotography, and organic photoreceptors using organic photoconductive materials have been developed, since they have advantages such as non-pollution and ease in production in comparison with inorganic photoconductive materials.

In general, an organic photoreceptor is composed of an electroconductive support and a photosensitive layer disposed thereon. Photoreceptors are classified into, for example, a so-called single-layer photoreceptor having a single photosensitive layer (single photosensitive layer) containing a binder resin dissolving or dispersing a photoconductive material therein; and a so-called multilayered photoreceptor composed of a plurality of laminated layers (laminated photosensitive layer) including a charge-generating layer containing a charge-generating material and a charge-transporting layer containing a charge-transporting material.

In the organic photoreceptor, changes in use environment of the photoreceptor or changes in electric characteristics during repeated use may cause various defects in an image formed with the photoreceptor. As a technology to solve such problems, a reliable method for forming a good image is to use an undercoat layer that contains a binder resin and titanium oxide particles and is disposed between an electroconductive substrate and a photosensitive layer (for example, refer to Patent Document 1).

The layer of the organic photoreceptor is generally formed by applying and drying a coating liquid prepared by dissolving or dispersing a material in a solvent, because of its high productivity. In such a case, since the titanium oxide particles and the binder resin are incompatible with each other in the undercoat layer, the coating liquid for forming the undercoat layer is provided in the form of a dispersion of titanium oxide particles.

Such a coating liquid has been generally produced by wet-dispersing titanium oxide particles in an organic solvent using a known mechanical pulverizer, such as a ball mill, a sand grind mill, a planetary mill, or a roll mill, by spending a long period of time (for example, refer to Patent Document 1). Furthermore, it is disclosed that when titanium oxide particles are dispersed in a coating liquid for forming an undercoat layer using a dispersion medium, an electrophotographic photoreceptor that exhibits excellent characteristics in repeated charging-exposure cycles even under conditions of low temperature and low humidity can be provided using titania or zirconia as the dispersion medium (for example, refer to Patent Document 2).

[Patent Document 1] Japanese Unexamined Patent Application Publication No. Hei 11-202519

[Patent Document 2] Japanese Unexamined Patent Application Publication No. Hei 6-273962

DISCLOSURE OF INVENTION

Problems to be Solved by the Invention

However, since higher-quality images are required, the performance of the conventional technology is insufficient in various respects such as quality of images formed and stability of coating liquids during a manufacturing process. For example, in recording of a high-quality image (high density) having a resolution of 600 dpi or more, image defects, such as black spots, color spots, unevenness, and streaks, readily become obvious, and interference fringes (generally, referred to as moire), which is caused by a relationship between the surface profile of a support and laser exposure when an image is formed, readily occur.

The present invention has been made in consideration of the above-described circumstances of the electrophotographic technology, and it is an object to provide a coating liquid for forming an undercoat layer having a high stability, a method for preparing the coating liquid, an electrophotographic photoreceptor that can form a high-quality image even under various operation conditions and exhibits high performance in forming images that have reduced image defects such as black spots and color spots, and, an image-forming apparatus and an electrophotographic cartridge that include the electrophotographic photoreceptor.

Means for Solving the Problems

The present inventors have conducted intensive studies for solving the above-mentioned problems and, as a result, have found the fact that a coating liquid for forming an undercoat layer exhibiting high performance can be obtained by controlling the particle size of metal oxide particles, such as titanium oxide particles, contained in the coating liquid for forming an undercoat layer within a specific range; and the coating liquid for forming an undercoat layer exhibiting excellent application stability can be obtained by conducting dispersion for preparing the coating liquid for forming an undercoat layer using a dispersion medium having a particle diameter smaller than those of dispersion media that are generally used. Furthermore, the present inventors have found the fact that a photoreceptor including an undercoat layer obtained by applying and drying the coating liquid for forming an undercoat layer can exhibit satisfactory electric characteristics even under various operation conditions; and also an image-forming apparatus including the photoreceptor can form high-quality images having significantly reduced image defects such as black spots and color spots that are probably caused by dielectric breakdown.

Based on the above findings, the present inventors have completed the present invention.

Accordingly, an aspect of the present invention relates to a coating liquid for forming an undercoat layer of an electrophotographic photoreceptor containing metal oxide particles and a binder resin, wherein the metal oxide particles have a cumulative volume average diameter D50 of 0.1 μm or less and a volume particle size distribution width index SD satisfying the following Expression (1) which are measured by a dynamic light-scattering method in the coating liquid for forming an undercoat layer, $$0.010 \leqq SD \leqq 0.040 \quad (1)$$

(where SD=(D84−D16)/2, where D84 represents the particle diameter (μm) at a point of 84% in the cumulative volume particle size distribution curve, and D16 represents the particle diameter (μm) at a point of 16% in the cumulative volume particle size distribution curve; and particle size distribution is accumulated from the smaller particle size side) (claim 1).

The SD here preferably satisfies the following Expression (2):

$$0.020 \leqq SD \leqq 0.030 \quad (2) \text{ (claim 2).}$$

Another aspect of the present invention relates to a method for preparing a coating liquid for forming an undercoat layer of an electrophotographic photoreceptor containing metal oxide particles and a binder resin, wherein the metal oxide particles are dispersed using a medium having an average particle diameter of 5 to 200 μm in a wet agitating ball mill, and the metal oxide particles have a cumulative volume average diameter D50 of 0.1 μm or less and a volume particle size distribution width index SD satisfying Expression (1) which are measured by a dynamic light-scattering method in the coating liquid for forming an undercoat layer (claim 3).

The SD here preferably satisfies Expression (2) (claim 4).

In the method for preparing a coating liquid for forming an undercoat layer, it is preferable that the wet agitating ball mill include a cylindrical stator, a slurry-supplying port disposed at one end of the stator, a slurry-discharging port disposed at the other end of the stator, a rotor for agitating and mixing a medium packed in the stator and a slurry supplied from the supplying port, a separator that is rotatably connected to the discharging port and separates the medium and the slurry by centrifugal force to discharge the slurry from the discharging port, and a shaft serving as a rotary shaft of the separator and having a hollow discharging path communicating with the discharging port at the center of the shaft (claim 5).

Furthermore, in the method for preparing a coating liquid for forming an undercoat layer, it is preferable that the wet agitating ball mill include a cylindrical stator, a slurry-supplying port disposed at one end of the stator, a slurry-discharging port disposed at the other end of the stator, a rotor for agitating and mixing the above-mentioned medium packed in the stator and the slurry supplied from the supplying port, and a separator that is disposed in the stator so as to be rotatably connected to the discharging port and separates the medium and the slurry by centrifugal force to discharge the slurry from the discharging port and that the separator include two disks having blade-fitting grooves on the inner faces facing each other, the blade fitted to the fitting grooves and lying between the disks, and supporting means supporting the disks having the blade therebetween from both sides (claim 6).

The medium preferably has an average particle diameter of 10 to 100 μm (claim 7).

Another aspect of the present invention relates to an electrophotographic photoreceptor including an undercoat layer containing a binder resin and metal oxide particles on an electroconductive support, and a photosensitive layer disposed on the undercoat layer, wherein the metal oxide particles have a cumulative volume average diameter D50' of 0.1 μm or less and a volume particle size distribution width index SD' satisfying the following Expression (3) which are measured by a dynamic light-scattering method in a liquid containing the undercoat layer dispersed in a solvent mixture of methanol and 1-propanol at a weight ratio of 7:3, $$0.010 \leqq SD' \leqq 0.040 \quad (3)$$

(where SD'=(D84'−D16')/2, where D84' represents the particle diameter (μm) at a point of 84% in the cumulative volume particle size distribution curve, and D16' represents the particle diameter (μm) at a point of 16% in the cumulative volume particle size distribution curve; and particle size distribution is accumulated from the smaller particle size side) (claim 8).

The SD' here preferably satisfies the following Expression (4):

$$0.020 \leqq SD' \leqq 0.030 \quad (4) \text{ (claim 9).}$$

Another aspect of the present invention relates to an image-forming apparatus including an electrophotographic photoreceptor, charging means for charging the electrophotographic photoreceptor, image exposure means for forming an electrostatic latent image by subjecting the charged electrophotographic photoreceptor to image exposure, development means for developing the electrostatic latent image with toner, and transfer means for transferring the toner to a transfer object, wherein the electrophotographic photoreceptor includes an undercoat layer containing a binder resin and metal oxide particles on an electroconductive support, and a photosensitive layer disposed on the undercoat layer; and the metal oxide particles have a cumulative volume average diameter D50' of 0.1 μm or less and a volume particle size distribution width index SD' satisfying the above-mentioned Expression (3) which are measured by a dynamic light-scattering method in a liquid containing the undercoat layer dispersed in a solvent mixture of methanol and 1-propanol at a weight ratio of 7:3 (claim 10).

The SD' here preferably satisfies the above-mentioned Expression (4) (claim 11).

In addition, the charging means is preferably configured to come into contact with the electrophotographic photoreceptor (claim 12).

Furthermore, the image exposure means preferably uses light having a wavelength of 350 to 600 nm (claim 13).

Another aspect of the present invention relates to an electrophotographic cartridge including an electrophotographic photoreceptor and at least one of charging means for charging the electrophotographic photoreceptor, image exposure means for forming an electrostatic latent image by subjecting the charged electrophotographic photoreceptor to image exposure, development means for developing the electrostatic latent image with toner, transfer means for transferring the toner to a transfer object, fixing means for fixing the toner transferred to the transfer object, and cleaning means for recovering the toner adhering to the electrophotographic photoreceptor, wherein the electrophotographic photoreceptor includes an undercoat layer containing a binder resin and metal oxide particles on an electroconductive support, and a photosensitive layer disposed on the undercoat layer; and the metal oxide particles have a cumulative volume average diameter D50' of 0.1 μm or less and a volume particle size distribution width index SD' satisfying the above-mentioned Expression (3) which are measured by a dynamic light-scattering method in a liquid containing the undercoat layer dispersed in a solvent mixture of methanol and 1-propanol at a weight ratio of 7:3 (claim 14).

The SD' here preferably satisfies the above-mentioned Expression (4) (claim 15).

In addition, the charging means is preferably configured to come into contact with the electrophotographic photoreceptor (claim 16).

ADVANTAGES

Accordingly, the present invention can provide a coating liquid for forming an undercoat layer having high stability, a method for preparing the coating liquid, an electrophotographic photoreceptor that can form a high-quality image even under various operation conditions and exhibits high performance in forming images that have reduced image defects such as black spots, color spots, and moire, and an image-forming apparatus and an electrophotographic cartridge that include the electrophotographic photoreceptor.

REFERENCE NUMERALS

Figure 1:
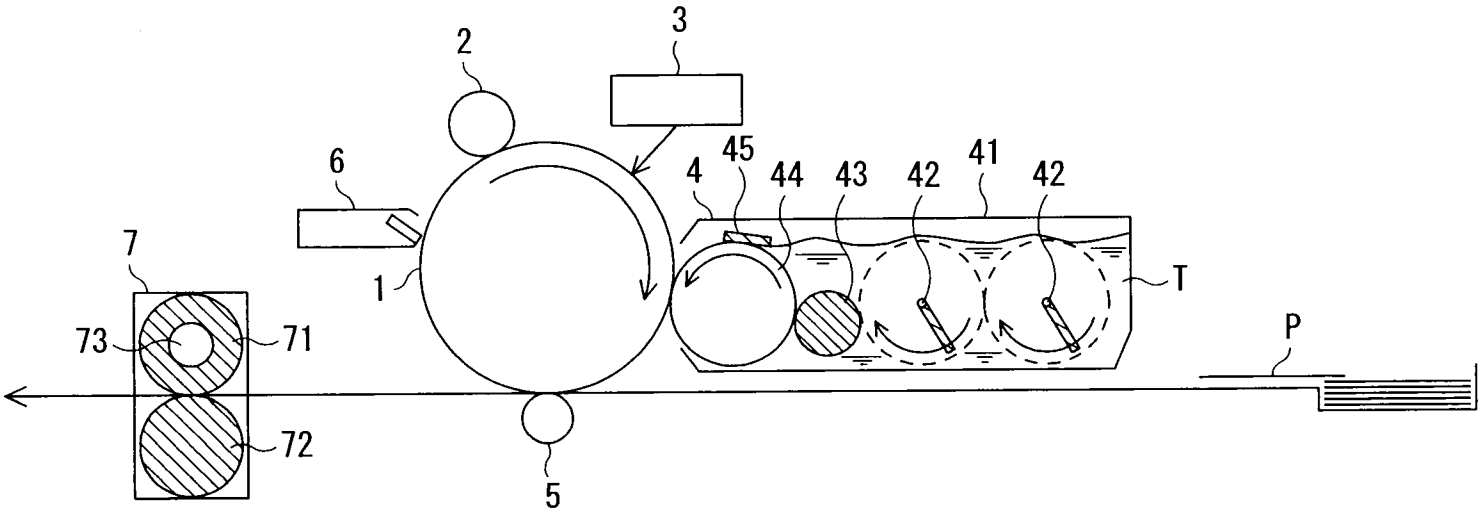
FIG. 1 is a schematic view illustrating the main structure of an embodiment of an image-forming apparatus provided with an electrophotographic photoreceptor of the present invention.

1 photoreceptor
2 charging device (charging roller)
3 exposure device
4 development device
5 transfer device
6 cleaning device
7 fixing device
14 separator
15 shaft
16 jacket
17 stator
19 discharging path
21 rotor
24 pulley
25 rotary joint
26 raw slurry supplying port
27 screen support
28 screen
29 product slurry retrieval port
31 disk
32 blade
35 valve element
41 development bath
42 agitator
43 supply roller
44 development roller
45 regulation member
71 upper fixing member (fixing roller)
72 lower fixing member (fixing roller)
73 heating device
100 seal ring
101 mating ring
102 spring
103 fitting groove
104 O-ring
105 shaft
106 separator
107 spacer
108 rotor
109 stopper
110 screw
111 discharging path
112 hole
113 spacer
114 blade fitting groove
115 disk
116 blade
T toner
P transfer material (paper, medium)

BEST MODES FOR CARRYING OUT THE INVENTION

Embodiments of the present invention will be described in detail below, but the description of components below is merely exemplary embodiments of the present invention. Accordingly, various modifications can be made within the scope of the present invention.

The present invention relates to a coating liquid for forming an undercoat layer of an electrophotographic photoreceptor, a method for preparing the coating liquid, an electrophotographic photoreceptor having an undercoat layer formed by applying and drying the coating liquid for forming an undercoat layer, an image-forming apparatus including the electrophotographic photoreceptor, and an electrophotographic cartridge including the electrophotographic photoreceptor.

The electrophotographic photoreceptor of the present invention includes an undercoat layer and a photosensitive layer on an electroconductive support. The undercoat layer according to the present invention is provided between the electroconductive support and the photosensitive layer and has at least one of functions including an improvement in adhesion between the electroconductive support and the photosensitive layer, covering of blot and scratches of the electroconductive support, prevention of carrier injection due to impurities or non-uniform surface properties, an improvement in uniformity of electric characteristics, prevention of a decrease in surface potential during repeated use, and prevention of a change in local surface potential, which causes image defects. The undercoat layer is unnecessary for achieving photoelectric characteristics.

[I. Coating Liquid for Forming Undercoat Layer]

The coating liquid for forming an undercoat layer of the present invention is used for forming an undercoat layer, and contains metal oxide particles and a binder resin. In addition, the coating liquid for forming an undercoat layer of the present invention generally contains a solvent. Furthermore, the coating liquid for forming an undercoat layer of the present invention may contain other components within the range that do not significantly impair the effects of the present invention.

[I-1. Metal Oxide Particle]

[I-1-1. Kind of Metal Oxide Particles]

Any metal oxide particle that can be used in an electrophotographic photoreceptor can be used as the metal oxide particles according to the present invention.

Examples of metal oxides that form the metal oxide particles include metal oxides containing single metal elements, such as titanium oxide, aluminum oxide, silicon oxide, zirconium oxide, zinc oxide, and iron oxide; and metal oxides containing multiple metal elements, such as calcium titanate, strontium titanate, and barium titanate. Among them, metal oxide particles composed of a metal oxide having a band gap of 2 to 4 eV are preferred. When the band gap is too small, carrier injection from the electroconductive support easily occurs, resulting in image defects such as black spots and color spots. When the band gap is too large, charge transfer is precluded by electron trapping, resulting in deterioration of electric characteristics.

Furthermore, the metal oxide particles may be composed of one kind of particles or any combination of different kinds of particles in any ratio. In addition, the metal oxide particles may be composed of one kind of metal oxide or may be any combination of two or more kinds of metal oxides in any ratio.

The metal oxide forming the metal oxide particles is preferably titanium oxide, aluminum oxide, silicon oxide, or zinc oxide, more preferably titanium oxide or aluminum oxide, and particularly preferably titanium oxide.

Furthermore, the metal oxide particles may have any crystal form that does not significantly impair the effects of the present invention. For example, the crystal form of the metal oxide particles composed of titanium oxide (i.e., titanium oxide particles) is not limited and may be any of rutile, anatase, brookite, or amorphous. In addition, these crystal forms of the titanium oxide particles may be present together.

Furthermore, the metal oxide particles may be subjected to various kinds of surface treatment, for example, treatment with a treating agent such as an inorganic material, e.g., tin oxide, aluminum oxide, antimony oxide, zirconium oxide, or silicon oxide or an organic material, e.g., stearic acid, a polyol, or an organic silicon compound.

In particular, when titanium oxide particles are used as the metal oxide particles, surface treatment is preferably conducted with an organic silicon compound.

Examples of the organic silicon compound include silicone oils such as dimethylpolysiloxane and methylhydrogenpolysiloxane; organosilanes such as methyldimethoxysilane and diphenyldimethoxysilane; silazanes such as hexamethyldisilazane; and silane coupling agents such as vinyltrimethoxysilane, γ-mercaptopropyltrimethoxysilane, and γ-aminopropyltriethoxysilane.

Furthermore, the metal oxide particles are preferably treated with a silane treating agent represented by the following Formula (i). The silane treating agent has high reactivity with metal oxide particles and is therefore favorable.

[Chemical Formula 1]

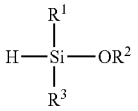

(i)

In Formula (i), $R^1$ and $R^2$ each independently represent an alkyl group. The carbon numbers of $R^1$ and $R^2$ are not limited, but are each usually one or more and usually 18 or less, preferably 10 or less, and more preferably 6 or less. Preferable examples of $R^1$ and $R^2$ include a methyl group and an ethyl group.

In addition, in Formula (i), $R^3$ represents an alkyl group or an alkoxy group. The carbon number of $R^3$ is not limited, but is usually one or more and usually 18 or less, preferably 10 or less, and more preferably 6 or less. Preferable examples of $R^3$ include a methyl group, an ethyl group, a methoxy group, and an ethoxy group.

A larger number of carbon atoms of $R^1$ to $R^3$ may cause a decrease in the reactivity with metal oxide particles or a decrease in the dispersion stability, in a coating liquid, of the metal oxide particles after treatment.

The outermost surfaces of these surface-treated metal oxide particles are usually treated with a treating agent described above. In such a case, the above-described surface treatment may be one kind of treatment or may be any combination of two or more kinds of treatment. For example, before the surface treatment with a silane treating agent represented by Formula (i), treatment with a treating agent, such as aluminum oxide, silicon oxide, or zirconium oxide, may be conducted. Furthermore, any combination of metal oxide particles subjected to different kinds of surface treatment in any ratio may be employed.

Examples of commercial products of the metal oxide particles according to the present invention are shown below, but the metal oxide particles according to the present invention are not limited to the products shown below.

Commercially available examples of the titanium oxide particles include ultrafine titanium oxide particles without surface treatment, "TTO-55 (N)"; ultrafine titanium oxide particles coated with $Al_2O_3$, "TTO-55 (A)" and "TTO-55 (B)"; ultrafine titanium oxide particles surface-treated with stearic acid, "TTO-55 (C)"; ultrafine titanium oxide particles surface-treated with $Al_2O_3$ and organosiloxane, "TTO-55 (S)"; high-purity titanium oxide "CR-EL"; titanium oxide produced by a sulfate process, "R-550", "R-580", "R-630", "R-670", "R-680", "R-780", "A-100", "A-220", and "W-10"; titanium oxide produced by a chlorine process, "CR-50", "CR-58", "CR-60", "CR-60-2", and "CR-67"; and electroconductive titanium oxide, "SN-100P", "SN-100D", and "ET-300 W" (these are manufactured by Ishihara Industry Co., Ltd.); titanium oxide such as "R-60", "A-110", and "A-150"; titanium oxide coated with $Al_2O_3$, "SR-1", "R-GL", "R-5N", "R-5N-2", "R-52N", "RK-1", and "A-SP"; titanium oxide coated with $SiO_2$ and $Al_2O_3$, "R-GX" and "R-7E"; titanium oxide coated with ZnO, $SiO_2$, and $Al_2O_3$, "R-650"; and titanium oxide coated with $ZrO_2$ and $Al_2O_3$, "R-61N" (these are manufactured by Sakai Chemical Industry Co., Ltd.); titanium oxide surface-treated with $SiO_2$ and $Al_2O_3$, "TR-700"; titanium oxide surface-treated with ZnO, $SiO_2$, and $Al_2O_3$, "TR-840" and "TA-500"; titanium oxide without surface treatment, "TA-100", "TA-200", and "TA-300"; and titanium oxide surface-treated with $Al_2O_3$, "TA-400" (these are manufactured by Fuji Titanium Industry Co., Ltd.); and titanium oxide without surface treatment, "MT-150W" and "MT-500B"; titanium oxide surface-treated with $SiO_2$ and $Al_2O_3$, "MT-100SA" and "MT-500SA"; and titanium oxide surface-treated with $SiO_2$, $Al_2O_3$ and organosiloxane, "MT-100SAS" and "MT-500SAS" (these are manufactured by Tayca Corp.).

Commercially available examples of the aluminum oxide particles include "Aluminium Oxide C" (manufactured by Nippon Aerosil Co., Ltd.).

Commercially available examples of the silicon oxide particles include "200CF" and "R972" (manufactured by Nippon Aerosil Co., Ltd.) and "KEP-30" (manufactured by Nippon Shokubai Co., Ltd.).

Commercially available examples of the tin oxide particles include "SN-100P" (manufactured by Ishihara Industry Co., Ltd.).

Commercially available examples of the zinc oxide particles include "MZ-305S" (manufactured by Tayca Corp.).

[I-1-2. Physical Properties of Metal Oxide Particles]

The metal oxide particles according to the present invention meet the following requirements for the particle diameter distribution. That is, the metal oxide particles have a cumulative volume average diameter D50 of 0.1 μm or less and a volume particle size distribution width index SD satisfying the following Expression (1) which are measured by a dynamic light-scattering method in the coating liquid for forming an undercoat layer of the present invention, $$0.010 \leqq SD \leqq 0.040 \quad (1)$$

where SD=(D84−D16)/2, D84 represents the particle diameter (μm) at a point of 84% in the cumulative volume particle size distribution curve, and D16 represents the particle diameter (μm) at a point of 16% in the cumulative volume particle size distribution curve; and particle size distribution is accumulated from the smaller particle size side.

This will be described in detail below.

[Description for Cumulative Volume Average Diameter D50]

The metal oxide particles according to the present invention have a cumulative volume average diameter D50 of 0.1 μm or less, preferably 95 nm or less, and more preferably 90 nm or less.

The metal oxide particles in the coating liquid for forming an undercoat layer according to the present invention are desirably present in the form of primary particles. However, in general, it is rare, and, in many cases, the metal oxide particles are aggregated into secondary particles or are present as a mixture of the both. Therefore, the state of the particle size distribution of the metal oxide particles is significantly important.

Accordingly, in the present invention, precipitation and a change in viscosity in the coating liquid for forming an undercoat layer are reduced by controlling the cumulative volume average diameter D50 of the metal oxide particles in the coating liquid for forming an undercoat layer to the above-mentioned range (0.1 μm or less). This allows the resulting undercoat layer to have uniform thickness and surface properties. When the cumulative volume average diameter D50 of the metal oxide particles is too large (when larger than 0.1 μm), precipitation and a change in viscosity in the coating liquid for forming an undercoat layer are rather accelerated, resulting in irregularity of the thickness and the surface properties of the resulting undercoat layer. This may adversely affect the quality of overlying layers (such as a charge-generating layer).

The cumulative volume average diameter D50 of the metal oxide particles has no lower limit, but is usually 0.02 μm or more. When the cumulative volume average diameter D50 is excessively low, the metal oxide particles may be agglomerated in a dispersion such as the coating liquid for forming an undercoat layer of the present invention.

[Description of Volume Particle Size Distribution Width Index SD]

The metal oxide particles according to the present invention usually have a volume particle size distribution width index SD of 0.010 or more and preferably 0.20 or more and usually 0.040 or less and preferably 0.030 or less. Therefore, the metal oxide particles of the present invention satisfy the following Expression (1) and preferably the following Expression (2):

$$0.010 \leqq SD \leqq 0.040 \quad (1)$$

$$0.020 \leqq SD \leqq 0.030 \quad (2)$$

If the metal oxide particles according to the present invention are present in the form of a monodispersed state with a single particle diameter, the volume particle size distribution width index SD is zero, which is ideal. However, actually, it is very difficult to practically obtain such an ideal state. The present inventors have newly discovered the fact that as long as the aggregation state is appropriately narrow, specifically, as long as the range of Expression (1) is satisfied, a coating liquid for forming an undercoat layer exhibits suppressed gelation tendency and a small change in viscosity and therefore can be stored for a long period of time, even if the metal oxide particles aggregate, and that the thickness and surface characteristics of the resulting undercoat layer can be uniform. On the other hand, when the metal oxide particles in a coating liquid for forming an undercoat layer do not satisfy Expression (1), for example, when D84 is too large, deposition of coarse particles is observed in the coating liquid for forming an undercoat layer; while, for example, when D16 is too small, agglomeration of fine particles is observed in the liquid. Thus, the gelation and a change in viscosity in the liquid are noticeable, and, as a result, the thickness and surface characteristics of the resulting undercoat layer are uneven. This may also adversely affect the quality of the overlying layers (such as a charge-generating layer).

[Method Of Measurement Of Cumulative Volume Average Diameter D50 and Volume Particle Size Distribution Width Index SD]

The cumulative volume average diameter D50 and the volume particle size distribution width index SD of the metal oxide particles of the present invention are values obtained by directly measuring the particle diameters of metal oxide particles in a coating liquid for forming an undercoat layer of the present invention by a dynamic light-scattering method. The values obtained by the dynamic light-scattering method are used regardless of the form of the metal oxide particles.

In the dynamic light-scattering method, the particle size distribution is determined by irradiating finely dispersed particles with laser light to detect the scattering (Doppler shift) of light beams having different phases depending on the velocity of the Brownian motion of these particles. The cumulative volume average diameter D50 and the volume particle size distribution width index SD of the metal oxide particles in the coating liquid for forming an undercoat layer of the present invention are those when the metal oxide particles are stably dispersed in the coating liquid for forming an undercoat layer and do not present particle diameters of the metal oxide particles in a powder form before the dispersion or of a wet cake. Specifically, the cumulative volume particle size distribution curve used for the measurement of the cumulative volume average diameter D50 and the volume particle size distribution width index SD is actually measured with a dynamic light-scattering particle size analyzer (MICROTRAC UPA, model: 9340-UPA, manufactured by Nikkiso Co., Ltd., hereinafter abbreviated to UPA) under the conditions shown below. The actual measurement is conducted according to the instruction manual of the particle size analyzer (Nikkiso Co., Ltd., Document No. T15-490A00, revision No. E).

Setting of the Dynamic Light-Scattering Particle Size Analyzer

Upper measurement limit: 5.9978 μm

Lower measurement limit: 0.0035 μm

Number of channels: 44

Measurement time: 300 sec.

Particle transparency: absorptive

Particle refractive index: N/A (not applicable)

Particle shape: non-spherical

Density: 4.20 g/cm$^3$ (*)

Dispersion medium: solvent used in the coating liquid for forming an undercoat layer (**)

Refractive index of dispersion medium: refractive index of the solvent used in the coating liquid for forming an undercoat layer (*) This density value is applicable to titanium dioxide particles, and, for other particles, values described in the instruction manual are used.

(**) In the present invention, the dispersion medium (namely, solvent used in the coating liquid for forming an undercoat layer) is preferably a solvent mixture of methanol/propanol=7/3, unless otherwise specified.

If the concentration of the coating liquid for forming an undercoat layer is too high and is outside of the range that a measurement apparatus can measure, the coating liquid for forming an undercoat layer is diluted with a solvent mixture of methanol and 1-propanol (weight ratio: methanol/1-propanol=7/3, refractive index=1.35) such that the resulting concentration of the coating liquid for forming an undercoat layer is within the measurable range of the measurement apparatus. For example, in the case of the above-mentioned UPA, the coating liquid for forming an undercoat layer is diluted with a solvent mixture of methanol and 1-propanol into a sample concentration index (SIGNAL LEVEL) within the range from 0.6 to 0.8, which is suitable for measurement.

Since, even if such dilution is conducted, it is believed that the volume particle diameter of the metal oxide particles in the coating liquid for forming an undercoat layer does not vary, the cumulative volume average diameter D50 and the volume particle size distribution width index SD after the dilution are regarded as "the cumulative volume average diameter D50 and the volume particle size distribution width index SD of the metal oxide particles, measured by the dynamic light-scattering method, in the coating liquid for forming an undercoat layer".

The particle size by dynamic light-scattering is measured at 25° C.

The cumulative volume average diameter D50 in the present invention represents, when a cumulative curve of the volume particle size distribution is plotted from the minimum particle size where the total volume of the powder is 100%, the particle diameter (μm) at a point of 50% in the cumulative curve, and is defined as the medium diameter (median diameter).

The volume particle size distribution width index SD in the present invention is defined as follows: When the particle diameter (μm) at a point of 84% in a cumulative curve (cumulative volume particle size distribution curve) of volume particle size distribution cumulated from the minimum particle diameter is defined as D84, and, similarly, the particle diameter (μm) at a point of 16% in the cumulative curve is defined as D16, the volume particle size distribution width index SD is represented by the following Expression (A):

$$SD\ (\mu m)=(D84-D16)/2 \quad (A)$$

The absorbance of the coating liquid for forming an undercoat layer of the present invention can be measured by a generally known absorption spectrophotometer. Since the conditions for measuring absorbance, such as a cell size and sample concentration, vary depending on physical properties, such as particle diameter and refractive index, of metal oxide particles used, the sample concentration is properly adjusted so as not to exceed the detection limit of a detector in a wavelength region (400 to 1000 nm in the present invention) to be measured. In the present invention, the concentration of the metal oxide particles in the liquid is controlled to 0.0075 wt % to 0.012 wt %. In general, the solvent for adjusting the sample concentration is the same as that used in the coating liquid for forming an undercoat layer. However, any solvent that has compatibility to the solvent of the coating liquid for forming an undercoat layer and the binder resin and does not cause roiling or the like and does not have high light absorption in a wavelength region of 400 to 1000 nm can be used. Examples of such solvents include alcohols such as methanol, ethanol, 1-propanol, and 2-propanol; hydrocarbons such as toluene and xylene; ethers such as tetrahydrofuran; and ketones such as methyl ethyl ketone and methyl isobutyl ketone.

The cell size (light path length) used for the measurement is 10 mm. Any cell substantially transparent in the range of 400 nm to 1000 nm can be used. Quartz cells are preferably used, and matched cells having the difference in transmittance characteristics between a sample cell and a standard cell within a predetermined range are particularly preferred.

In a dispersion prepared by dispersing the coating liquid for forming an undercoat layer of the present invention in a solvent mixture of methanol and 1-propanol at a weight ratio of 7:3, the difference between the absorbance to light with 400 nm wavelength and the absorbance to light with 1000 nm wavelength is preferably 1.0 (Abs) or less for a refractive index of metal oxide particles of 2.0 or more, or is preferably 0.02 (Abs) or less for a refractive index of metal oxide particles of 2.0 or less.

[Other Physical Properties]

The metal oxide particles according to the present invention may have any average primary particle diameter that does not significantly impair the effects of the present invention. However, the average primary particle diameter of the metal oxide particles according to the present invention is usually 1 nm or more and preferably 5 nm or more and usually 100 nm or less, preferably 70 nm or less, and more preferably 50 nm or less.

This average primary particle diameter can be determined based on the arithmetic mean value of the diameters of particles that are directly observed by a transmission electron microscope (hereinafter, optionally, referred to as "TEM").

Also, the refractive index of the metal oxide particles according to the present invention does not have any limitation, and those that can be used in electrophotographic photoreceptors can be used. The refractive index of the metal oxide particles according to the present invention is usually 1.3 or more and preferably 1.4 or more and usually 3.0 or less, preferably 2.9 or less, and more preferably 2.8.

In addition, as the refractive index of metal oxide particles, reference values described in various publications can be used. For example, they are shown in the following Table 1 according to Filler Katsuyo Jiten (Filler Utilization Dictionary, edited by Filler Society of Japan, Taiseisha LTD., 1994).

TABLE 1

| | Refractive index |
|---|---|
| Titanium oxide (rutile) | 2.76 |
| Lead titanate | 2.70 |
| Potassium titanate | 2.68 |
| Titanium oxide (anatase) | 2.52 |
| Zirconium oxide | 2.40 |
| Zinc sulfide | 2.37 to 2.43 |
| Zinc oxide | 2.01 to 2.03 |
| Magnesium oxide | 1.64 to 1.74 |
| Barium sulfate (precipitated) | 1.65 |
| Calcium sulfate | 1.57 to 1.61 |
| Aluminum oxide | 1.56 |
| Magnesium hydroxide | 1.54 |
| Calcium carbonate | 1.57 to 1.60 |
| Quartz glass | 1.46 |

The coating liquid for forming an undercoat layer of the present invention can contain the metal oxide particles and the binder resin at any ratio that does not significantly impair the effects of the present invention. However, in the coating liquid for forming an undercoat layer of the present invention, the amount of the metal oxide particles to one part by weight of the binder resin is usually 0.3 part by weight or more, preferably 0.5 part by weight or more, more preferably 0.7 part by weight or more, and particularly preferably 1.0 part by weight or more and usually 20 parts by weight or less, preferably 10 parts by weight or less, more preferably 4 parts by weight or less, and particularly preferably 3.5 parts by weight or less. A smaller ratio of the metal oxide particles to the binder resin may cause unsatisfactory electric characteristics of the resulting electrophotographic photoreceptor, in particular, an increase in the residual potential. A larger ratio of the metal oxide particles may cause noticeable image defects, such as black spots and color spots, in an image formed with the electrophotographic photoreceptor.

[I-2. Binder Resin]

The coating liquid for forming an undercoat layer of the present invention can contain any binder resin that does not significantly impair the effects of the present invention. In general, a binder resin that can be used is soluble in a solvent such as an organic solvent and is insoluble or hardly soluble in and substantially immiscible with a solvent such as an organic solvent that is used in a coating liquid for forming a photosensitive layer.

Examples of such a binder resin include phenoxy resins, epoxy resins, polyvinylpyrrolidone, polyvinyl alcohol, casein, polyacrylic acid, celluloses, gelatin, starch, polyurethane, polyimide, and polyamide. These resins may be used alone or in the cured form with a curing agent. In particular, polyamide resins such as alcohol-soluble copolymerized polyamides and modified polyamides exhibit favorable dispersibility and coating characteristics, and are preferred.

Examples of the polyamide resin include so-called copolymerized nylons, such as copolymers of 6-nylon, 66-nylon, 610-nylon, 11-nylon, and 12-nylon; and alcohol-soluble nylon resins, such as chemically modified nylons, e.g., N-alkoxymethyl-modified nylon and N-alkoxyethyl-modified nylon. Examples of commercially available products include "CM4000" and "CM8000" (these are manufactured by Toray Industries, Inc.), and "F-30K", "MF-30", and "EF-30T" (these are manufactured by Nagase Chemtex Corporation).

Among these polyamide resins, particularly preferred is a copolymerized polyamide resin containing a diamine component corresponding to a diamine represented by the following Formula (ii) (hereinafter, optionally, referred to as "diamine component corresponding to Formula (ii)").

[Chemical Formula 2]

(ii)

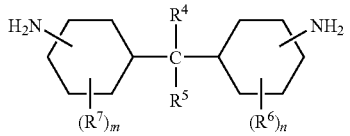

In Formula (ii), each of $R^4$ to $R^7$ represents a hydrogen atom or an organic substituent, and m and n each independently represent an integer of from 0 to 4. When a plurality of the substituents are present, these substituents may be the same or different from each other.

Preferable examples of the organic substituent represented by $R^4$ to $R^7$ include hydrocarbon groups that may contain hetero atoms. Among them, preferred examples are alkyl groups such as a methyl group, an ethyl group, an n-propyl group, and an isopropyl group; alkoxy groups such as a methoxy group, an ethoxy group, an n-propoxy group, and an isopropoxy group; and aryl groups such as a phenyl group, a naphthyl group, an anthryl group, and a pyrenyl group. More preferred are an alkyl group and an alkoxy group; and particularly preferred are a methyl group and an ethyl group.

The number of the carbon atoms in the organic substituent represented by $R^4$ to $R^7$ is not limited as long as the effects of the present invention are not significantly impaired, and is usually 20 or less, preferably 18 or less, and more preferably 12 or less and usually 1 or more. When the number of the carbon atoms is too large, the solubility is decreased. Consequently, the storage stability of the coating liquid for forming an undercoat layer is detracted even if the resin can be temporarily dissolved.

The copolymerized polyamide resin containing a diamine component corresponding to Formula (ii) may contain a constitutional unit other than the diamine component corresponding to Formula (ii) (hereinafter, optionally, referred to as "other polyamide constituent" simply). Examples of the other polyamide constituent include lactams such as γ-butyrolactam, ϵ-caprolactam, and lauryllactam; dicarboxylic acids such as 1,4-butanedicarboxylic acid, 1,12-dodecanedicarboxylic acid, and 1,20-eicosanedicarboxylic acid; diamines such as 1,4-butanediamine, 1,6-hexamethylenediamine, 1,8-octamethylenediamine, and 1,12-dodecanediamine; and piperazine. Furthermore, the copolymerized polyamide resin may be, for example, a binary, tertiary, or quaternary copolymer of the constituent.

When the copolymerized polyamide resin containing the diamine component corresponding to Formula (ii) contains another polyamide constitutional unit, the amount of the diamine component corresponding to Formula (ii) to the total constituents is not limited, but is usually 5 mol % or more, preferably 10 mol % or more, and more preferably 15 mol % or more and usually 40 mol % or less and preferably 30 mol % or less. A significantly large amount of the diamine component corresponding to Formula (ii) may lead to poor stability of the coating liquid for forming an undercoat layer. A significantly small amount may lead to considerably low stability of the electric characteristics under conditions of high temperature and high humidity against environmental changes.

Examples of the copolymerized polyamide resin are shown below. In these examples, the copolymerization ratio represents the feed ratio (molar ratio) of monomers.

[Chemistry Formula 3]

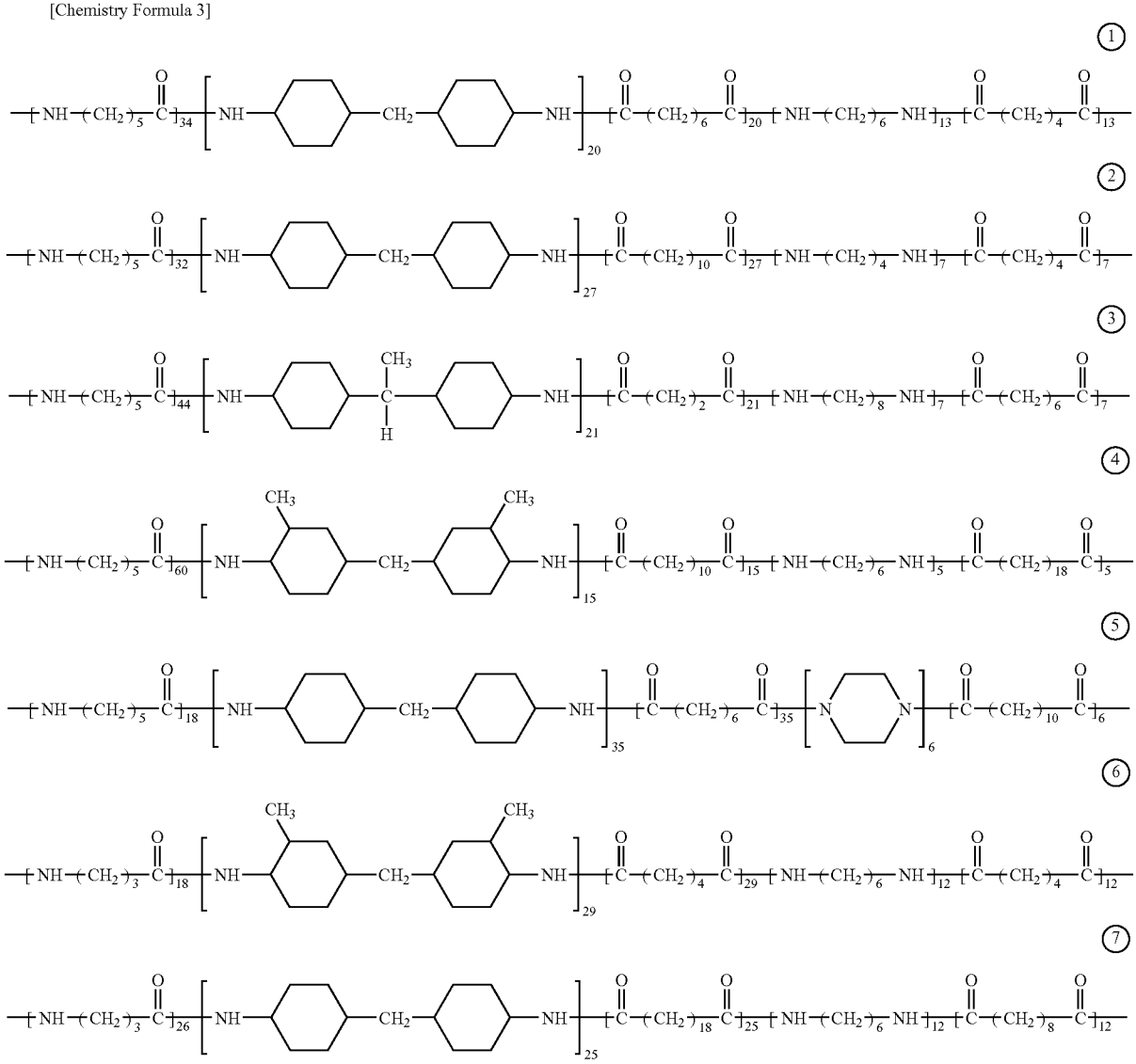

The copolymerized polyamide may be produced by any method without particular limitation and is properly produced by usual polycondensation of polyamide. For example, polycondensation such as melt polymerization, solution polymerization, or interfacial polymerization can be properly employed. Furthermore, in the polymerization, for example, a monobasic acid such as acetic acid or benzoic acid; or a monoacidic base such as hexylamine or aniline may be contained in a polymerization system as a molecular weight adjuster.

The binder resins may be used alone or in any combination of two or more kinds in any ratio.

Furthermore, the binder resin according to the present invention may have any number average molecular weight without limitation. For example, for a binder resin of copolymerized polyamide, the number average molecular weight of the copolymerized polyamide is usually 10000 or more and preferably 15000 or more and usually 50000 or less and preferably 35000 or less. If the number average molecular weight is too small or too large, the undercoat layer tends to be difficult to maintain the uniformity.

The binder resin may be contained in the coating liquid for forming an undercoat layer of the present invention at any content that does not significantly impair the effects of the present invention, and the content of the binder resin in the coating liquid for forming an undercoat layer of the present invention is usually 0.5 wt % or more and preferably 1 wt % or more and usually 20 wt % or less and preferably 10 wt % or less.

[I-3. Solvent]

Any solvent can be used as a solvent for the coating liquid for forming an undercoat layer (solvent for the undercoat layer) of the present invention as long as it can dissolve the binder resin according to the present invention. The solvent is usually an organic solvent, and examples thereof include alcohols containing at most five carbon atoms, such as methanol, ethanol, isopropyl alcohol, and normal propyl alcohol; halogenated hydrocarbons such as chloroform, 1,2-dichloroethane, dichloromethane, trichlene, carbon tetrachloride, and 1,2-dichloropropane; nitrogen-containing organic solvents such as dimethylformamide; and aromatic hydrocarbons such as toluene and xylene.

Furthermore, these solvents may be used alone or in any combination of two or more kinds in any ratio. Furthermore, even if a solvent alone cannot dissolve the binder resin according to the present invention, the solvent can be used in the form of a mixture with another solvent (for example, the organic solvents described above) that can dissolve the binder resin as the mixture. In general, a solvent mixture can advantageously reduce unevenness in coating.

In the coating liquid for forming an undercoat layer of the present invention, the ratio of solid components, such as the metal oxide particles and the binder resin, to the solvent varies depending on the method for coating the coating liquid for forming an undercoat layer and may be determined such that uniform coating can be formed in the coating method that is applied. Specifically, the solid content in the coating liquid for forming an undercoat layer is usually 1 wt % or more and preferably 2 wt % or more and usually 30 wt % or less and preferably 25 wt % or less, from the viewpoints of stability and coating characteristics of the coating liquid for forming an undercoat layer.

[I-4. Other Components]

The coating liquid for forming an undercoat layer of the present invention may contain other components in addition to the metal oxide particles, the binder resin, and the solvent within a range that does not significantly impair the effects of the present invention. For example, the coating liquid for forming an undercoat layer may contain any additive as the other component.

Examples of the additive include thermal stabilizers represented by sodium phosphite, sodium hypophosphite, phosphorous acid, hypophosphorous acid, and hindered phenol; and other polymerization additives. The additives may be used alone or in any combination of two or more kinds in any ratio.

[I-5. Advantage of Coating Liquid for Forming an Undercoat Layer of the Present Invention]

The coating liquid for forming an undercoat layer of the present invention has high storage stability. There are many measures of storage stability, for example, in the coating liquid for forming an undercoat layer of the present invention, the rate of change in viscosity after storage for 120 days at room temperature compared to that immediately after the production (i.e., the value obtained by dividing a difference between the viscosity after storage for 120 days and the viscosity immediately after the production by the viscosity immediately after the production) is usually 20% or less, preferably 15% or less, and more preferably 10% or less. The viscosity can be measured by a method in accordance with JIS Z 8803 using an E-type viscometer (product name: ED, manufactured by Tokimec Inc.).

Furthermore, the use of the coating liquid for forming an undercoat layer of the present invention enables highly efficient production of electrophotographic photoreceptors with high quality.

[II. Method for Preparing Coating Liquid for Forming an Undercoat Layer]

The coating liquid for forming the undercoat layer according to the present invention may be produced by any method without limitation. However, the coating liquid for forming an undercoat layer according to the present invention contains metal oxide particles as described above, and the metal oxide particles are present in the form of dispersion in the coating liquid for forming an undercoat layer. Therefore, the method for preparing the coating liquid for forming an undercoat layer of the present invention usually includes a step of dispersing the metal oxide particles.

[II-1. Dispersion of Metal Oxide Particles]

The metal oxide particles may be dispersed in a solvent (hereinafter, optionally, the solvent used for dispersion is referred to as "dispersion solvent") by, for example, wet dispersion using a known mechanical pulverizer (dispersing apparatus), such as a ball mill, a sand grind mill, a planetary mill, or a roll mill. It is believed that the metal oxide particles according to the present invention are dispersed so as to have the above-described predetermined particle diameter distribution through this dispersion step. The dispersion solvent may be that used in the coating liquid for forming the undercoat layer or may be another solvent. However, when a solvent other than the solvent used in the coating liquid for forming the undercoat layer is used as the dispersion solvent, the metal oxide particles and the solvent to be used in the coating liquid for forming an undercoat layer are mixed or subjected to solvent exchange after the dispersion. In such an occasion, it is preferable that the mixing or the solvent exchange be carried out so as to avoid aggregation of the metal oxide particles in order to maintain the predetermined particle diameter distribution.

Among wet dispersion methods, a dispersion using a dispersion medium is particularly preferred.

Any known dispersing apparatus can be used for dispersing using a dispersion medium, and examples thereof include a pebble mill, a ball mill, a sand mill, a screen mill, a gap mill, a vibration mill, a paint shaker, and an attritor. Among them, a dispersion apparatus that disperse metal oxide particles by circulation is preferable. Furthermore, from the viewpoints of, for example, dispersion efficiency, final particle size, and continuous operation, wet agitating ball mills such as a sand mill, a screen mill, and a gap mill are particularly preferred. These mills may be either of a vertical type or a horizontal type. In addition, the disk of the mill may have any shape. For example, a flat plate type, a vertical pin type, or a horizontal pin type can be used. A liquid circulating type sand mill is preferred.

The dispersion may be conducted with one type of dispersion apparatus or with any combination of two or more types.

In the dispersion using a dispersion medium, the cumulative volume average diameter D50 is reduced and the volume particle size distribution width index SD is adjusted in the above-mentioned ranges by using a dispersion medium having a predetermined average particle diameter.

That is, in the method for preparing a coating liquid for forming an undercoat layer of the present invention, when metal oxide particles are dispersed in a wet agitating ball mill, the dispersion medium of the wet agitating ball mill have an average particle diameter of usually 5 μm or more and preferably 10 μm or more and usually 200 μm or less and preferably 100 μm or less. A dispersion medium having a smaller particle diameter tends to give a homogeneous dispersion within a shorter period of time. However, a dispersion medium having an excessively small particle diameter has significantly small mass, which may preclude efficient dispersion.

It is believed that the use of the dispersion medium having the above-described average particle diameter in the preparation process is a factor for adjusting the cumulative volume average diameter D50 and the volume particle size distribution width index SD of the metal oxide particles in the coating liquid for forming an undercoat layer within the desired ranges. Therefore, the coating liquid for forming an undercoat layer prepared using the metal oxide particles dispersed with a dispersion medium having the above-mentioned average particle diameter in a wet agitating ball mill favorably satisfies the requirements of the coating liquid for forming an undercoat layer of the present invention.

That is, in a preferred method for preparing the coating liquid for forming an undercoat layer of the present invention, a coating liquid for forming an undercoat layer of an electrophotographic photoreceptor containing metal oxide particles and a binder resin is prepared by dispersing the metal oxide particles with a dispersion medium having an average particle diameter of 5 to 200 μm in a wet agitating ball mill. The metal oxide particles have a cumulative volume average diameter D50 of 0.1 μm or less and a volume particle size distribution width index SD satisfying Expression (1) which are measured by a dynamic light-scattering method in the coating liquid for forming an undercoat layer. The volume particle size distribution width index SD preferably satisfies the above-mentioned Expression (2).

Since the dispersion medium is usually substantially spherical, the average particle diameter can be determined by a sieving method using sieves described in, for example, JIS Z 8801:2000 or image analysis, and the density can be measured by Archimedes's method. For example, the average particle diameter and the sphericity of the dispersion medium can be measured with an image analyzer represented by LUZEX50 manufactured by Nireco Corp.

The density of the dispersion medium is not limited, but is usually 5.5 g/cm$^3$ or more, preferably 5.9 g/cm$^3$ or more, and more preferably 6.0 g/cm$^3$ or more. In general, a dispersion medium having a higher density tends to give homogeneous dispersion within a shorter time. The sphericity of the dispersion medium is preferably 1.08 or less and more preferably 1.07 or less.

As the material of the dispersion medium, any known dispersion medium can be used, as long as it is insoluble in a dispersion solvent contained in the slurry, has a specific gravity higher than that of the slurry, and does not react with the slurry nor decompose the slurry. Examples of the dispersion medium include steel balls such as chrome balls (bearing steel balls) and carbon balls (carbon steel balls); stainless steel balls; ceramic balls such as silicon nitride, silicon carbide, zirconium, and alumina balls; and balls coated with films of, for example, titanium nitride or titanium carbonitride. Among them, preferred are ceramic balls, and particularly preferred are fired zirconium balls are more preferred. More specifically, fired zirconium beads described in Japanese Patent No. 3400836 are particularly preferred.

The dispersion media may be used alone or in any combination of two or more types in any ratio.

Among the aforementioned wet agitating ball mills, preferably used is one including a cylindrical stator, a slurry supplying port disposed at one end of the stator, a slurry discharging port disposed at the other end of the stator, a rotor for agitating and mixing a dispersion medium packed in the stator and slurry supplied from the supplying port, and a separator that is rotatably connected to the discharging port and separates the dispersion medium and the slurry by the centrifugal force to discharge the slurry from the discharging port.

The slurry here contains at least metal oxide particles and a dispersion solvent.

Now, the structure of this wet agitating ball mill will be described in detail.

The stator is a tubular (usually, cylindrical) container having a hollow portion inside thereof and is provided with a slurry supplying port at one end and a slurry discharging port at the other end. In addition, the hollow portion of the inside is filled with a dispersion medium so that metal oxide particles in slurry are dispersed by the dispersion medium. Furthermore, the slurry is supplied to the inside of the stator from the supplying port, and the slurry in the stator is discharged from the discharging port to the exterior of the stator.

The rotor is disposed in the interior of the stator and agitates and mixes the dispersion medium and the slurry. The rotor may be of any type such as a pin, disk, or annular type.

Furthermore, the separator separates the dispersion medium and the slurry. This separator is connected to the discharging port of the stator, separates the slurry and the dispersion medium from each other in the stator, and discharges the slurry from the discharging port of the stator to the exterior of the stator.

The separator used here is rotatable and is desirably of an impeller-type. The separator is configured such that the dispersion medium and the slurry are separated from each other by centrifugal force that is generated by the rotation of the separator.

The separator may be rotated in synchronization with the rotor or independently of the rotor.

Furthermore, the wet agitating ball mill preferably includes a shaft serving as a rotary shaft of the separator.

In addition, this shaft is preferably provided with a hollow discharging path communicating with the discharging port, at the center of the shaft. That is, it is preferable that the wet agitating ball mill include at least a cylindrical stator, a slurry supplying port disposed at one end of the stator, a slurry discharging port disposed at the other end of the stator, a rotor agitating and mixing a dispersion medium packed in the stator and slurry supplied from the supplying port, an impeller separator that is connected to the discharging port and is rotatable to separate the dispersion medium and the slurry from each other by centrifugal force and discharge the slurry from the discharging port, and a shaft serving as the rotary shaft of the separator where a hollow discharging path connected to the discharging port is disposed in the center of the shaft.

The discharging path formed in the shaft connects the rotary center of the separator and the discharging port of the stator. Therefore, the slurry separated from the dispersion medium by the separator is transported to the discharging port through the discharging path and is then discharged from the discharging port to the exterior of the stator. The discharging path extends through the center of the shaft. Since the centrifugal force does not work at the center of the shaft, the slurry discharged has no kinetic energy. Consequently, wasteful kinetic energy is not generated, and so excess energy is not consumed.

Such a wet agitating ball mill may be horizontally disposed, but is preferably vertically disposed in order to increase the filling ratio of the dispersion medium. In the vertical installation, the discharging port is preferably disposed at the upper end of the mill. Furthermore, the separator is desirably disposed at a position above the level of the packed dispersion medium.

When the discharging port is disposed at the upper end of the mill, the supplying port is disposed at the bottom of the mill. In this case, more preferably, the supplying port consists of a valve seat and a vertically movable valve element that is fitted to the valve seat and has a V-shape, a trapezoidal shape, or a cone shape so as to be in line contact with the edge of the valve seat. With this, an annular slit can be formed between the edge of the valve seat and the valve element to prevent a dispersion medium from passing through. Therefore, at the supplying port, slurry is supplied without deposition of the dispersion medium. In addition, it is possible to discharge the dispersion medium by spreading the slit by lifting the valve element or to seal the mill by closing the slit by lowering the valve element. Furthermore, since the slit is defined by the valve element and the edge of the valve seat, coarse particles (metal oxide particles) in the slurry are barely caught in and, even if caught, the particles can be readily removed upward or downward. Thus, occlusion hardly occurs.

In addition, coarse particles trapped in the slit can be removed from the slit by vertical vibration of the valve element with vibration means, and occlusion of the particles can also be prevented by the vibration. Furthermore, the vibration of the valve element applies shearing force to the slurry to decrease the viscosity thereof, resulting in an increased amount of slurry passing through the slit (i.e., the amount of supply). Any means can be used for vibrating the valve element without limitation. For example, in addition to mechanical means such as a vibrator, means of changing the pressure of compressed air that acts on a piston combined with the valve element, such as a reciprocating compressor or an electromagnetic switching valve of switching supply and discharge of compressed air, can be used.

Such a wet agitating ball mill is desirably provided with a screen for separating the dispersion medium and a slurry outlet at the bottom so that the slurry remaining in the wet agitating ball mill can be discharged after the completion of dispersion.

Furthermore, in the case that the wet agitating ball mill is vertically disposed, the shaft is pivoted at the upper end of the stator, an O-ring and a mechanical seal having a mating ring are disposed at a bearing portion bearing the shaft disposed at the upper end of the stator, the bearing portion is provided with an annular groove for fitting the O-ring, and the O-ring is fitted to the annular groove, it is preferable that a tapered cut broadening downward be provided at the lower side of the annular groove. That is, it is preferable that the wet agitating ball mill include a cylindrical vertical stator, a slurry supplying port disposed at the bottom of the stator, a slurry discharging port disposed at the upper end of the stator, a shaft pivoted at the upper end of the stator and rotated by driving means such as a motor, a pin-, disk-, or annular rotor fixed to the shaft and agitating/mixing the dispersion medium packed in the stator and the slurry supplied from the supplying port, a separator disposed near the discharging port and separating the dispersion medium from the slurry, and a mechanical seal disposed at the bearing portion bearing the shaft at the upper end of the stator, and that a tapered cut broadening downward be provided at the lower side of an annular groove for fitting an O-ring that is in contact with a mating ring of the mechanical seal.

In this wet agitating ball mill, the mechanical seal is provided at the upper end of the stator above the level of the liquid in the center of the shaft at which the dispersion medium and the slurry substantially do not have kinetic energy. This can significantly reduce intrusion of the dispersion medium and the slurry into a gap between the mating ring of the mechanical seal and the lower side portion of the O-ring fitting groove.

Furthermore, the lower side of the annular groove for fitting the O-ring broadens downward by a cut so that the clearance spreads. Therefore, intrusion of the slurry and the dispersion medium or clogging caused by solidification thereof hardly occurs, and the mating ring smoothly follows the seal ring to maintain the functions of the mechanical seal. In addition, the lower portion of the fitting groove to which the O-ring is fitted has a V-shaped cross-section. Since the entire wall is not thin, the strength is maintained, and the O-ring has high holding ability.

In particular, the separator preferably includes two disks having blade-fitting grooves on the inner faces facing each other, a blade fitted to the fitting grooves and lying between the disks, and supporting means supporting the disks having the blade therebetween from both sides. That is, it is preferable that the wet agitating ball mill include a cylindrical stator, a slurry supplying port disposed at one end of the stator, a slurry discharging port disposed at the other end of the stator, a rotor agitating and mixing the dispersion medium packed in the stator and the slurry supplied from the supplying port, and a rotatable separator provided in the stator, connected to the discharging port, separating the slurry from the dispersion medium by centrifugal force, and discharging the slurry from the discharging port, and that the separator include two disks having fitting grooves for a blade on the inner faces facing each other, the blade fitted to the fitting grooves and lying between the disks, and supporting means supporting the disks having the blade therebetween from both sides. In such a case, preferably, the supporting means is defined by a shoulder of a shouldered shaft and cylindrical pressing means fitted to the shaft and pressing the disks, and supports the disks having the blade therebetween by pinching them from both sides with the shoulder of the shaft and the pressing means. With such a wet agitating ball mill, the metal oxide particles in the coating liquid for forming an undercoat layer of the present invention can satisfy Expressions (1) and (2). The separator here preferably has an impeller-type structure.

The structure of the above-described vertical wet agitating ball mill will now be more specifically described with reference to an embodiment of the wet agitating ball mill. However, the agitating apparatus used for preparing the coating liquid for an undercoat layer of the present invention is not limited to those exemplified here.

Figure 3:
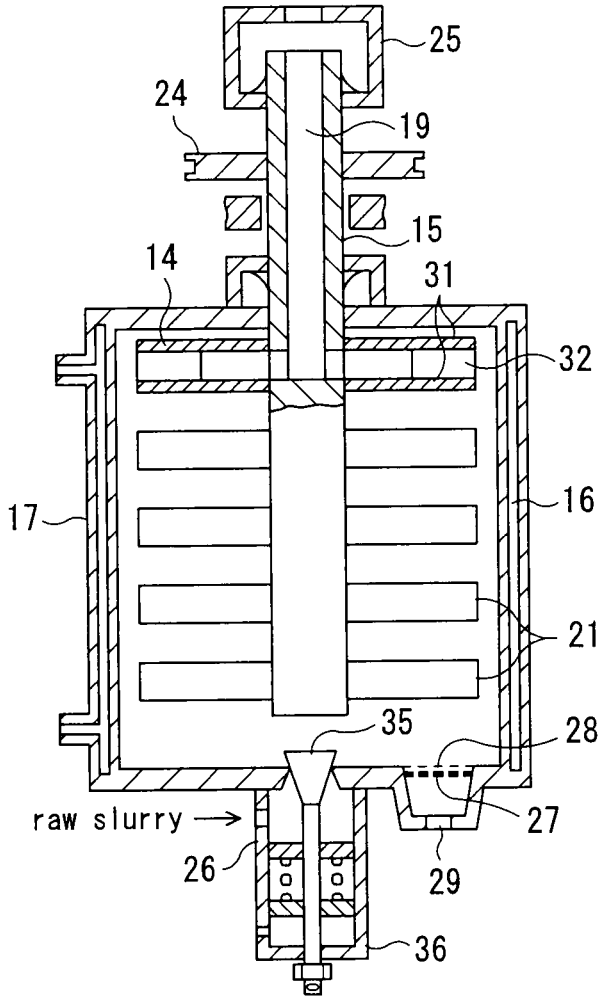
FIG. 3 is a longitudinal cross-sectional view schematically illustrating a structure of a wet agitating ball mill according to an embodiment of the present invention.

FIG. 3 is a longitudinal cross-sectional view schematically illustrating a structure of a wet agitating ball mill according to this embodiment. In FIG. 3, slurry (not shown) is supplied to the vertical wet agitating ball mill and is agitated with a dispersion medium (not shown) in the mill for pulverization. Then, the slurry is separated from the dispersion medium by a separator 14 and is discharged through a discharging path 19 in the center of a shaft 15 and then is recycled via a return path (not shown) for further milling.

As shown in FIG. 3 in detail, the vertical wet agitating ball mill has a stator 17 provided with a vertically cylindrical jacket 16 that allows a flow of water for cooling the mill; a shaft 15 that is rotatably born on the upper portion of the stator 17 at the center of the stator 17 and has a mechanical seal shown in FIG. 4 (described below) at a bearing portion and has a hollow center as a discharging path 19 at the upper portion; pin- or disk-shaped rotors 21 protruding in the radial direction at the lower portion of the shaft 15; a pulley 24, for transmitting driving force, fixed to the upper portion of the shaft 15; a rotary joint 25 mounted on an open end at the upper end of the shaft 15; a separator 14, for separating the medium, fixed to the shaft 15 near the upper portion in the stator 17; a slurry supplying port 26 disposed to the bottom of the stator 17 so as to oppose to the end of the shaft 15; and a screen 28, for separating the dispersion medium, mounted on a grid screen support 27 that is provided to a slurry outlet 29 disposed at an eccentric position of the bottom of the stator 17.

The separator 14 consists of a pair of disks 31 fixed to the shaft 15 with a predetermined interval and a blade 32 connecting these disks 31 to define an impeller and rotates with the shaft 15 to apply centrifugal force to the dispersion medium and the slurry entrapped between the disks 31 for centrifuging the dispersion medium in the radial direction and discharging the slurry through the discharging path 19 in the center of the shaft 15 by the difference in specific gravity.

The slurry supplying port 26 consists of an inverted trapezoidal valve element 35 that is vertically movable and is fitted to a valve seat disposed at the bottom of the stator 17 and a cylindrical body 36 having a bottom and protruding downward from the bottom of the stator 17. The valve element 35 is lifted upon the supply of slurry to form an annular slit (not shown) with the valve seat, whereby the slurry is supplied to the interior of the stator 17.

When a raw material is supplied, the valve element 35 is lifted by a supply pressure due to the slurry supplied to the inside of the cylindrical body 36, against the pressure in the mill, to form a slit between itself and the valve seat.

In order to prevent clogging of the slit, the valve element 35 repeats vertical shock involving lifting to the upper limit position within a short cycle. This vibration of the valve element 35 may be constantly performed, or may be performed when a large amount of coarse particles are contained in the slurry or in conjunction with an increase in supply pressure of the slurry due to clogging.

Figure 4:
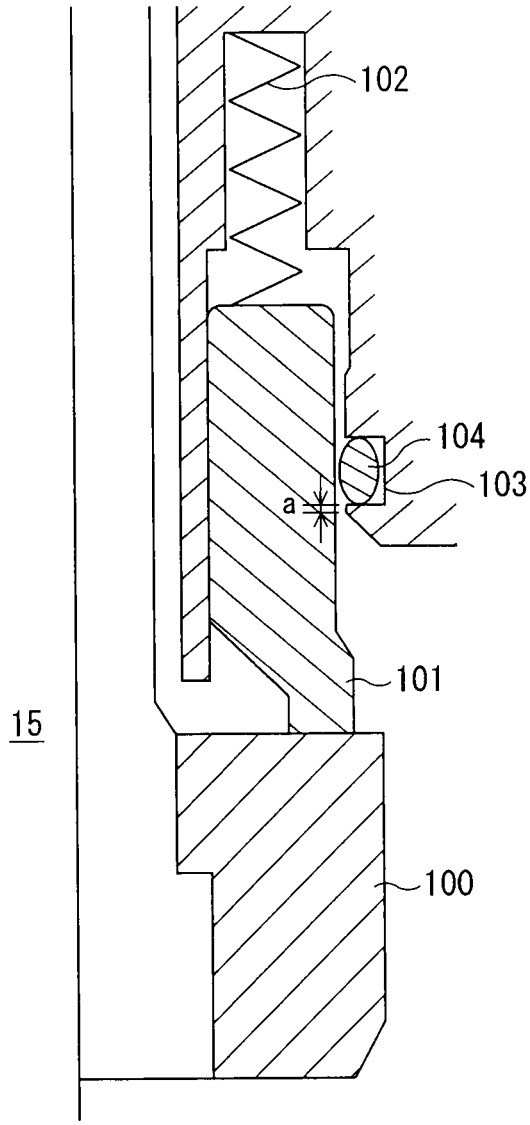
FIG. 4 is an enlarged longitudinal cross-sectional view schematically illustrating a mechanical seal used in a wet agitating ball mill according to an embodiment of the present invention.

In the mechanical seal, as shown in FIG. 4 in detail, a mating ring 101 at the stator side is biased by a spring 102 to a seal ring 100 fixed to the shaft 15. The stator 17 and the mating ring 101 are sealed by an O-ring 104 that is fitted to a fitting groove 103 at the stator side. In FIG. 4, a tapered cut (not shown) broadening downward is provided at the lower portion of the O-ring fitting groove 103. The length "a" of minimum clearance between the lower portion of the fitting groove 103 and the mating ring 101 is small in order to prevent deterioration of the sealing between the mating ring 101 and the seal ring 100 due to inhibited motion of the mating ring 101 by solidification of trapped medium or slurry.

In the above embodiment, the rotors 21 and the separator 14 are fixed to the same shaft 15. In another embodiment, however, they are fixed to different shafts coaxially arranged and are independently rotated. In the embodiment shown above, since the rotor and the separator are provided to the same shaft, a single driving apparatus is required, resulting in simplification of the structure. In the latter embodiment, the rotor and the shaft are mounted on the different shafts and are independently rotated by the respective driving apparatuses, and thus the rotor and the separator are independently driven at their optimum rotation rates.

Figure 5:
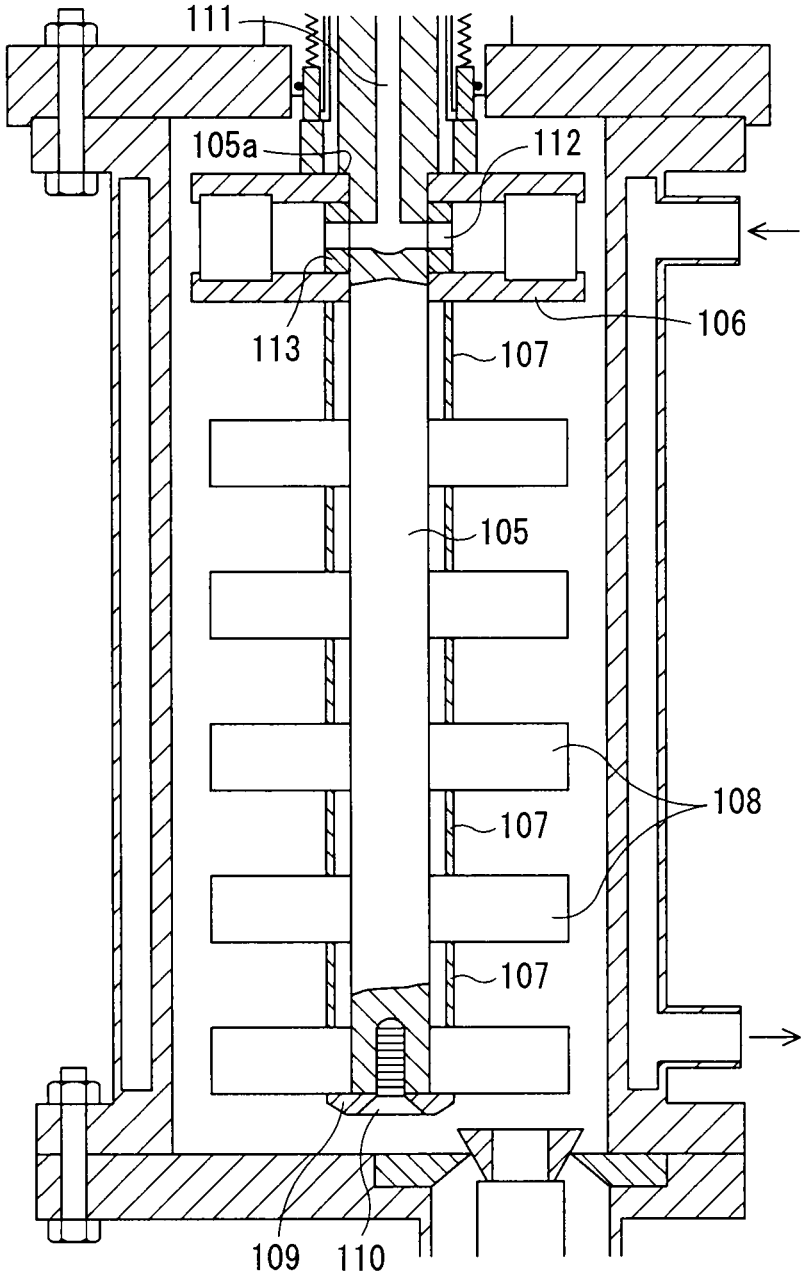
FIG. 5 is a longitudinal cross-sectional view schematically illustrating another example of a wet agitating ball mill according to an embodiment of the present invention.
Figure 6:
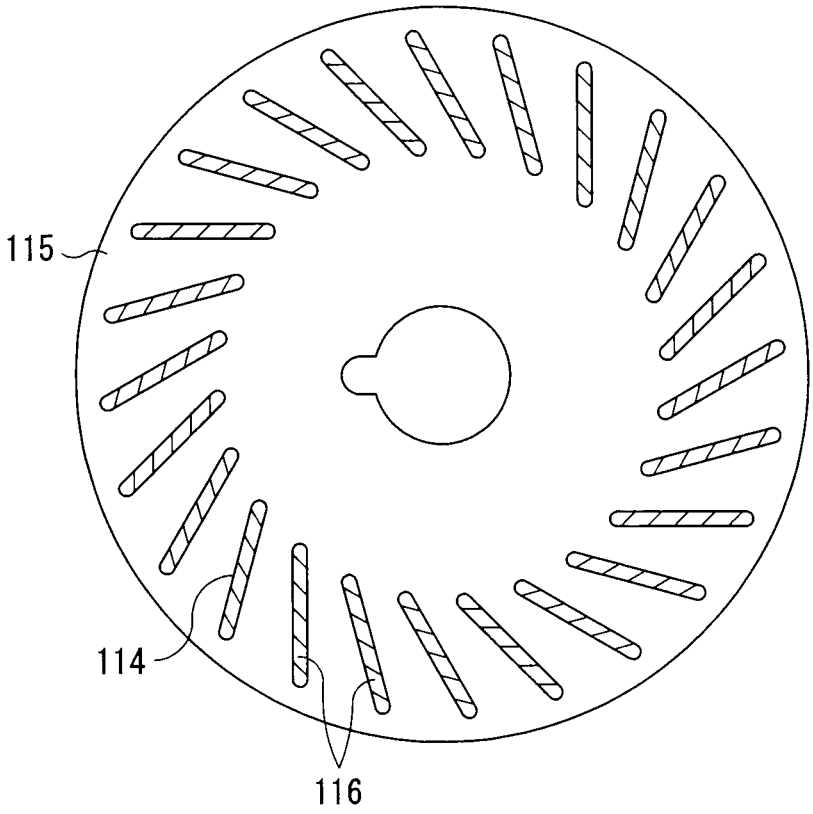
FIG. 6 is a horizontal cross-sectional view schematically illustrating a separator of the wet agitating ball mill shown in FIG. 5.

In the ball mill shown in FIG. 5, the shaft 105 is a shouldered shaft. A separator 106 is put on and fitted to the shaft from the lower end of the shaft, then spacers 107 and disk or pin rotors 108 are alternately put on and fitted to the shaft. Then a stopper 109 is fixed to the lower end of the shaft with a screw 110. Thus, the separator 106, the spacers 107, and the rotors 108 are interposed between the shoulder 105*a* of the shaft 105 and the stopper 109, and fixed in conjunction with each other. The separator 106 includes a pair of disks 115 each provided with blade fitting grooves 114, as shown in FIG. 6, on the inner surfaces facing each other, blades 116 interposing between both the disks and fitted to the blade fitting grooves 114, and an annular spacer 113 for securing a predetermined distance between these disks 115 and having a hole 112 communicating with a discharging path 111 to define an impeller.

An example of the wet agitating ball mill having a structure shown in this embodiment is an Ultra Apex Mill manufactured by Kotobuki Industries Co., Ltd.

Using the wet agitating ball mill of this embodiment having such a structure, slurry is dispersed through the following procedures: A dispersion medium (not shown) is packed in the stator 17 of the wet agitating ball mill of this embodiment, the rotors 21 and the separator 14 are rotated by driving force from an external power source, while a predetermined amount of slurry is supplied from the supplying port 26. As a result, the slurry is supplied to the interior of the stator 7 through the slit (not shown) formed between the edge of the valve seat and the valve element 35.

The slurry and the dispersion medium in the stator 7 are agitated and mixed by the rotation of the rotors 21 to pulverize the slurry. Furthermore, the dispersion medium and the slurry transferred by the rotation of the separator 14 into the separator 14 are separated from each other by the difference in specific gravity. The dispersion medium, which has a larger specific gravity, is centrifuged in the radial direction, and the slurry, which has a smaller specific gravity, is discharged through the discharging path 19 in the center of the shaft 15 toward a raw material tank. When the pulverization proceeds to some extent, the particle size may be optionally measured. If a desired particle size is obtained, the raw material pump is stopped once, and then mill driving is stopped to terminate the pulverization.

When metal oxide particles are dispersed in a wet agitating ball mill, the filling rate of the dispersion medium packed in the wet agitating ball mill is not limited, as long as the metal oxide particles can be dispersed into a predetermined particle size distribution. When metal oxide particles are dispersed in such a vertical wet agitating ball mill described above, the filling rate of the dispersion medium packed in the wet agitating ball mill is usually 50% or more, preferably 70% or more, and more preferably 80% or more and usually 100% or less, preferably 95% or less, and more preferably 90% or less.

The wet agitating ball mill used for dispersing metal oxide particles may have a separator of a screen or slit mechanism, but, as described above, an impeller-type is desirable and a vertical impeller type is preferable. The wet agitating ball mill is desirably of a vertical type having a separator at the upper portion of the mill. In particular, when the filling rate of the dispersion medium is adjusted to the above-mentioned range, pulverization is particularly efficiently performed, and the separator can be placed at a position higher than the level of the packed medium. This can prevent leakage of a dispersion medium which is carried on the separator.

The operation conditions of the wet agitating ball mill applied to the dispersion of metal oxide particles affect the cumulative volume average diameter D50 and the volume particle size distribution width index SD of the metal oxide particles in a coating liquid for forming an undercoat layer, the stability of the coating liquid for forming an undercoat layer, the surface shape of the undercoat layer formed by applying the coating liquid for forming an undercoat layer, and characteristics of an electrophotographic photoreceptor having the undercoat layer formed by applying the coating liquid for forming an undercoat layer. In particular, the slurry supplying rate and the rotation velocity of the rotor have significant influences.

The slurry-supplying rate affects the residence time of the slurry in the wet agitating ball mill. Accordingly, though the rate varies depending on the capacity and shape of the mill, in the case of a stator usually used, the rate is generally 20 kg/hour or more and preferably 30 kg/hour or more and usually 80 kg/hour or less and preferably 70 kg/hour or less per liter (hereinafter, optionally, referred to as "L") of the wet agitating ball mill.

The rotation velocity of the rotor is affected by parameters such as the shape of the rotor or the distance from the stator. In the case of a stator and a rotor usually used, the circumferential velocity at the top end of the rotor is usually 5 m/second or faster, preferably 8 m/second or faster, and more preferably 10 m/second or faster and usually 20 m/second or slower, preferably 15 m/second or slower, and more preferably 12 m/second or slower.

Furthermore, the amount of the dispersion medium is not limited. However, the volume ratio of the dispersion medium to slurry is usually 1 to 5. In addition, a dispersion aid that can be readily removed after the dispersion may be used together with the dispersion medium. Examples of the dispersion aid include sodium chloride and sodium sulfate.

The dispersion of metal oxide particles is preferably carried out by a wet process in the presence of a dispersion solvent. In addition to the dispersion solvent, any additional component may be present as long as the metal oxide particles can be properly dispersed. Examples of such an additional component include a binder resin and various types of additives.

Any dispersion solvent can be used without limitation, but the solvent that is used in the coating liquid for forming an undercoat layer is preferably used because of no requirement of steps, such as exchange of solvent, after the dispersion. These dispersion solvents may be used alone or as a solvent mixture of two or more kinds in any combination and any ratio.

The amount of the dispersion solvent used is in the range of usually 0.1 part by weight or more and preferably 1 part by weight or more and usually 500 parts by weight or less and preferably 100 parts by weight or less, on the basis of 1 part by weight of metal oxide particles to be dispersed, from the viewpoint of productivity.

The mechanical dispersion can be carried out at any temperature from the freezing point to the boiling point of a solvent (or solvent mixture), and is carried out at a temperature of usually 10° C. or higher and usually 200° C. or lower from the viewpoint of safe manufacturing operation.

After the dispersion treatment using a dispersion medium, it is preferable that the dispersion medium be separated from the slurry and further subjected to sonication. The sonication is a treatment of the metal oxide particles with ultrasonic vibration.

Conditions, such as a vibration frequency, for the sonication are not particularly limited, but ultrasonic vibration with a frequency of usually 10 kHz or more and preferably 15 kHz or more and usually 40 kHz or less and preferably 35 kHz or less from an oscillator is used.

Furthermore, the output of an ultrasonic oscillator is not particularly limited, but is usually 100 W to 5 kW.

In general, dispersion treatment of a small amount of slurry with ultrasound from a low output ultrasonic oscillator is more efficient compared to that of a large amount of slurry with ultrasound from a high output ultrasonic oscillator. Therefore, the amount of slurry to be treated at once is usually 1 L or more, preferably 5 L or more, and more preferably 10 L or more and usually 50 L or less, preferably 30 L or less, and more preferably 20 L or less. The output of an ultrasonic oscillator in such a case is preferably 200 W or more, more preferably 300 W or more, and particularly preferably 500 W or more and preferably 3 kW or less, more preferably 2 kW or less, and particularly preferably 1.5 kW or less.

The method of applying ultrasonic vibration to metal oxide particles is not particularly limited. For example, the treatment is carried out by directly immersing an ultrasonic oscillator in a container containing slurry, bringing an ultrasonic oscillator into contact with the outer wall of a container containing slurry, or immersing a container containing slurry in a liquid to which vibration is applied with an ultrasonic oscillator. Among these methods, preferably used is the method of immersing a container containing slurry in a liquid to which vibration is applied with an ultrasonic oscillator.

In such a case, the liquid to which vibration is applied with an ultrasonic oscillator is not limited, and examples thereof include water; alcohols such as methanol; aromatic hydrocarbons such as toluene; and oils such as a silicone oil. Among them, water is preferred, in consideration of safe manufacturing operation, cost, washing properties, and other factors.

In the method of immersing the container containing slurry in a liquid to which vibration is applied with an ultrasonic oscillator, since the efficiency of the sonication varies depending on the temperature of the liquid, it is preferable to maintain the temperature of the liquid constant. The applied vibration may raise the temperature of the liquid that is subjected to the ultrasonic vibration. Preferably, the temperature of the liquid subjected to the sonication is in the range of usually 5° C. or higher, preferably 10° C. or higher, and more preferably 15° C. or higher and usually 60° C. or lower, preferably 50° C. or lower, and more preferably 40° C. or lower.

The container for containing the slurry treated with ultrasound is not limited. For example, any container that is usually used for containing a coating liquid for forming an undercoat layer, which is used for forming a photosensitive layer of an electrophotographic photoreceptor, can be used. Examples of the container include containers made of resins such as polyethylene or polypropylene, glass containers, and metal cans. Among them, metal cans are preferred. In particular, an 18-liter metal can prescribed in JIS Z 1602 is preferred because of its high resistances to organic solvents and impacts.

The slurry after dispersion or after sonication is filtered before use, according to need, in order to remove coarse particles. The filtration medium in such a case may be any filtering material that is usually used for filtration, such as cellulose fiber, resin fiber, or glass fiber. A preferred form of the filtration medium is a so-called wound filter, which is made of a fiber wound around a core material, because it has a large filtration area to achieve high efficiency. Any known core material can be used, and examples thereof include stainless steel core materials and core materials made of resins, such as polypropylene, that are not dissolved in the slurry and the solvent contained in the slurry.

The resulting slurry is further mixed with, a solvent, a binder resin (binder), and other optional components (e.g., auxiliary agents) to give a coating liquid for forming an undercoat layer. The metal oxide particles may be mixed with the solvent of the coating liquid for forming an undercoat layer, the binder resin, and the other optional components, in any step of before, during, or after the dispersion or sonication process. Therefore, mixing of the metal oxide particles with the solvent, the binder resin, or the other components may not be necessarily carried out after the dispersion or sonication.

[II-2. Advantage of the Method for Preparing Coating Liquid for Forming an Undercoat Layer of the Present Invention]

According to the method for preparing the coating liquid for forming an undercoat layer of the present invention, the coating liquid for forming an undercoat layer according to the present invention can be efficiently produced and also can have higher storage stability. Therefore, an electrophotographic photoreceptor with higher quality can be efficiently obtained.

[III. Formation of Undercoat Layer]

The undercoat layer of the electrophotographic photoreceptor can be formed by applying the coating liquid for forming an undercoat layer of the present invention onto an electroconductive support and drying it. The method of applying the coating liquid for forming an undercoat layer of the present invention is not limited, and examples thereof include dip coating, spray coating, nozzle coating, spiral coating, ring coating, bar-coat coating, roll-coat coating, and blade coating. These coating methods may be carried out alone or in any combination of two or more kinds.

Examples of the spray coating include air spray, airless spray, electrostatic air spray, electrostatic airless spray, rotary atomizing electrostatic spray, hot spray, and hot airless spray. In consideration of the fineness of grains for obtaining a uniform thickness and adhesion efficiency, a preferred method is rotary atomizing electrostatic spray disclosed in Japanese Domestic Re-publication (Saikohyo) No. Hei 1-805198, that is, continuous conveyance without spacing in the axial direction with rotation of a cylindrical work. This can give an electrophotographic photoreceptor that exhibits high uniformity of thickness of the undercoat layer with overall high adhesion efficiency.

Examples of the spiral coating method include a method using an injection applicator or a curtain applicator, which is disclosed in Japanese Unexamined Patent Application Publication No. Sho 52-119651; a method of continuously spraying paint in the form of a line from a small opening, which is disclosed in Japanese Unexamined Patent Application Publication No. Hei 1-231966; and a method using a multi-nozzle body, which is disclosed in Japanese Unexamined Patent Application Publication No. Hei 3-193161.

In the case of the dip coating, in general, the total solid content in a coating liquid for forming an undercoat layer is in a range of usually 1 wt % or more and preferably 10 wt % or more and usually 50 mass % or less and preferably 35 wt % or less; and the viscosity is in a range of preferably 0.1 cps or more and preferably 100 cps or less, where 1 Cps=$1\times10^{-3}$ Pa·s.

After the application, the resulting coating is dried. It is preferable that the drying temperature and time be adjusted so as to achieve necessary and sufficient drying. The drying temperature is in a range of usually 100° C. or higher, preferably 110° C. or higher, and more preferably 115° C. or higher and usually 250° C. or lower, preferably 170° C. or lower, and more preferably 140° C. or lower. The drying method is not limited. For example, a hot air dryer, a steam dryer, an infrared dryer, or a far-infrared dryer can be used.

[IV. Electrophotographic Photoreceptor]

The electrophotographic photoreceptor of the present invention includes an undercoat layer on an electroconductive support and a photosensitive layer on the undercoat layer. Therefore, the undercoat layer is disposed between the electroconductive support and the photosensitive layer.

The photosensitive layer can have any constitution that can be applied to a known electrophotographic photoreceptor, and examples thereof include a so-called single-layer photoreceptor having a single photosensitive layer (single photosensitive layer) containing a binder resin dissolving or dispersing a photoconductive material therein; and a so-called multilayered photoreceptor composed of a plurality of laminated layers (laminated photosensitive layer) including a charge-generating layer containing a charge-generating material and a charge-transporting layer containing a charge-transporting material. It is known that the photoconductive material generally exhibits equivalent functional performance in both the single-layer and multilayered photoreceptors.

The photosensitive layer of the electrophotographic photoreceptor of the present invention may be present in any known form, but is preferably a multilayered photoreceptor, by taking mechanical physical properties, electric characteristics, manufacturing stability, and other characteristics of the photoreceptor into comprehensive consideration. In particular, a normally layered photoreceptor in which an undercoat layer, a charge-generating layer, and a charge-transporting layer are deposited on an electroconductive support in this order is more preferable.

Components of the electrophotographic photoreceptor of the present invention will now be described with reference to embodiments, but the components of the electrophotographic photoreceptor of the present invention are not limited to the following embodiments.

[IV-1. Electroconductive Support]

Any electroconductive support can be used without particular limitation, and examples of materials that are mainly used include metal materials such as aluminum, aluminum alloys, stainless steel, copper, and nickel; resin materials provided with conductivity by being mixed with an electroconductive powder, such as a metal, carbon, or tin oxide powder; and resins, glass, and paper of which the surfaces are coated with an electroconductive material, such as aluminum, nickel, or ITO (indium oxide-tin oxide alloy), by vapor deposition or coating.

In addition, the shape of the electroconductive support may be, for example, a drum, a sheet, or a belt. Furthermore, an electroconductive material having an appropriate resistance value may be coated on an electroconductive support of a metal material for controlling conductivity or surface properties or for covering defects.

Furthermore, in the case of the electroconductive support composed of a metal material such as an aluminum alloy, the metal material may be used after anodization treatment. If the anodization treatment is performed, it is desirable to conduct pore sealing treatment by a known method.

For example, an anodic oxide coating is formed by anodization in an acidic bath of, for example, chromic acid, sulfuric acid, oxalic acid, boric acid, or sulfamic acid. Among these acidic baths, anodization in sulfuric acid gives a particularly effective result. In the case of the anodization in sulfuric acid, preferred conditions are a sulfuric acid concentration of 100 to 300 g/L, a dissolved aluminum concentration of 2 to 15 g/L, a liquid temperature of 15 to 30° C., a bath voltage of 10 to 20 V, and a current density of 0.5 to 2 A/dm$^2$, but the conditions are not limited thereto.

It is preferable to conduct pore sealing to the resulting anodic oxide coating. The pore sealing may be conducted by a known method and is preferably performed by, for example, low-temperature pore sealing treatment, dipping in an aqueous solution containing nickel fluoride as a main component, or high-temperature pore sealing treatment, dipping in an aqueous solution containing nickel acetate as a main component.

The concentration of the nickel fluoride aqueous solution used in the low-temperature pore sealing treatment may be appropriately determined, but the concentration in the range of 3 to 6 g/L can give a better result. Furthermore, in order to smoothly carry out the pore sealing treatment, the treatment temperature range is usually 25° C. or higher and preferably 30° C. or higher and usually 40° C. or lower and preferably 35° C. or lower. In addition, from the same viewpoint, the pH range of the nickel fluoride aqueous solution is usually 4.5 or higher and preferably 5.5 or higher and usually 6.5 or lower and preferably 6.0 or lower. Examples of a pH regulator include oxalic acid, boric acid, formic acid, acetic acid, sodium hydroxide, sodium acetate, and aqueous ammonia. The treating time is preferably in the range of one to three minutes per micrometer of coating thickness. Furthermore, the nickel fluoride aqueous solution may contain, for example, cobalt fluoride, cobalt acetate, nickel sulfate, or a surfactant in order to further improve the coating physical properties. Then, washing with water and drying complete the low-temperature pore sealing treatment.

On the other hand, examples of the pore sealing agent for the high-temperature pore sealing treatment can include metal salt aqueous solutions of nickel acetate, cobalt acetate, lead acetate, nickel-cobalt acetate, and barium nitrate, and a nickel acetate aqueous solution is particularly preferred. The nickel acetate aqueous solution is preferably used in the concentration range of 5 to 20 g/L. The treatment temperature range is usually 80° C. or higher and preferably 90° C. or higher and usually 100° C. or lower and preferably 98° C. or lower. In addition, the pH of the nickel acetate aqueous solution is preferably in the range of 5.0 to 6.0. Here, examples of the pH regulator can include aqueous ammonia and sodium acetate. The treating time is usually 10 minutes or longer and preferably 15 minutes or longer. Furthermore, also the nickel acetate aqueous solution may contain, for example, sodium acetate, organic carboxylic acid, or an anionic or nonionic surfactant in order to improve physical properties of the resulting coating. In addition, high-temperature water or high-temperature water vapor substantially not containing salts may be used for the treatment. Then, washing with water and drying complete the high-temperature pore sealing treatment.

When the anodic oxide coating has a large average thickness, severer pore sealing conditions may be required for treatment in a higher concentration of pore sealing solution at a higher temperature for a longer period of time. In such a case, the productivity is decreased, and also surface defects, such as stains, blot, or blooming, may tend to occur on the coating surface. From these viewpoints, the anodic oxide coating is preferably formed so as to have an average thickness of usually 20 μm or less and particularly 7 μm or less.

The surface of the electroconductive support may be smooth or may be roughened by specific milling or by grinding treatment. In addition, the surface may be roughened by mixing particles having an appropriate particle diameter to the material constituting the support. Furthermore, a drawing tube can be directly used, without conducting milling treatment, for cost reduction. In particular, in the case of use of an aluminum support without milling treatment, such as drawing, impacting, or die processing, blot, adherents such as foreign materials, and small scratches present on the surface are eliminated by the treatment to give a uniform and clean support, and it is therefore preferred.

[IV-2. Undercoat Layer]

The undercoat layer contains a binder resin and metal oxide particles. In addition, the undercoat layer may contain other components that do not significantly impair the effects of the present invention. The binder resin, the metal oxide particles, and other components are the same as those described in the description of the coating liquid for forming an undercoat layer of the present invention.

Furthermore, in the electrophotographic photoreceptor of the present invention, the cumulative volume average diameter D50' and the volume particle size distribution width index SD' of the metal oxide particles which are measured by a dynamic light-scattering method in a liquid containing the undercoat layer dispersed in a solvent mixture of methanol and 1-propanol at a weight ratio of 7:3 satisfy the same requirements as those for the cumulative volume average diameter D50 and the volume particle size distribution width index SD, respectively.

Consequently, in the electrophotographic photoreceptor of the present invention, the cumulative volume average diameter D50' is 0.1 μm or less (refer to the description in [Description for Cumulative Volume Average Diameter D50]).

In addition, in the electrophotographic photoreceptor of the present invention, the volume particle size distribution width index SD' defined by "SD'=(D84'−D16')/2" satisfies the following Expression (3) and preferably satisfies Expression (4) (refer to the description in [Description of volume particle size distribution width index SD]).

$$0.010 \leqq SD' \leqq 0.040 \quad (3)$$

$$0.020 \leqq SD' \leqq 0.030 \quad (4)$$

(where D84' represents the particle diameter (μm) at a point of 84% in the cumulative volume particle size distribution curve, and D16' represents the particle diameter (μm) at a point of 16% in the cumulative volume particle size distribution curve; and particle size distribution is accumulated from the smaller particle size side).

The investigation by the present inventors has revealed that when the cumulative volume average diameter D50' and the volume particle size distribution width index SD' do not satisfy the above-mentioned ranges, the resulting photoreceptor exhibits unstable repeated exposure-charge characteristics at low temperature and low humidity and the resulting image frequently has image defects, such as black spots and color spots, which are disadvantageous.

The cumulative volume average diameter D50' and volume particle size distribution width index SD' are determined by dispersing the formed undercoat layer in a solvent mixture of methanol and 1-propanol at a weight ratio of 7:3 (this functions as a dispersion medium in the measurement of the particle size) and measuring the particle size of the metal oxide particles in this dispersion by a dynamic light-scattering method, not directly measuring that of the metal oxide particles in the coating liquid for forming an undercoat layer. In this point, the method is different from the method for measuring the cumulative volume average particle diameter D50 and the volume particle size distribution width index, but other points are the same (refer to the description in [Method of measurement of cumulative volume average diameter D50 and volume particle size distribution width index SD]).

The undercoat layer according to the present invention may be produced by any method without limitation and is generally formed using the above-described coating liquid for forming an undercoat layer of the present invention.

The undercoat layer may have any thickness. However, from the viewpoints of improvements in photoreceptive characteristics of the electrophotographic photoreceptor of the present invention and in coating characteristics, in usual, the thickness is preferably 0.1 μm or more and 20 μm or less. In addition, the undercoat layer may contain any known additive such as an antioxidant.

The undercoat layer according to the present invention may have any surface profile, but usually has characteristic in-plane root mean square roughness (RMS), in-plane arithmetic mean roughness (Ra), and in-plane maximum roughness (P-V). These numerical values are obtained by applying the reference lengths of the root mean square height, arithmetic mean height, and maximum height in the specification of JIS B 0601:2001 to a reference plane. The in-plane root mean square roughness (RMS) represents the root mean square of Z(x)'s, which are values in the height direction in the reference plane; the in-plane arithmetic mean roughness (Ra) represents the average of the absolute values of Z(x)'s;

and the in-plane maximum roughness (P-V) represents the sum of the maximum height and the maximum depth of Z(x).

The in-plane root mean square roughness (RMS) of the undercoat layer according to the present invention is usually 10 nm or more and preferably 20 nm or more and usually 100 nm or less and preferably 50 nm or less. A smaller in-plane root mean square roughness (RMS) may impair the adhesion to an overlying layer. A larger roughness may cause an uneven coating thickness of the overlying layer.

The in-plane arithmetic mean roughness (Ra) of the undercoat layer according to the present invention is usually 10 nm or more and usually 50 nm or less. A smaller in-plane arithmetic mean roughness (Ra) may impair the adhesion to an overlying layer. A larger roughness may cause an uneven coating thickness of the overlying layer.

The in-plane maximum roughness (P-V) of the undercoat layer according to the present invention is usually 100 nm or more and preferably 300 nm or more and usually 1000 nm or less and preferably 800 nm or less. A smaller in-plane maximum roughness (P-V) may impair adhesion to an overlying layer. A larger roughness may cause an uneven coating thickness of the overlying layer.

The measures (RMS, Ra, P-V) representing the surface profile may be determined with any surface analyzer that can precisely measure irregularities in the reference plane.

Particularly, it is preferred to determine these measures by a method of detecting irregularities on the surface of the sample by combining high-precision phase shift detection with counting of the order of interference fringes using an optical interferometer. More specifically, they are preferably measured by an interference fringe addressing method at a wave mode using Micromap manufactured by Ryoka Systems Inc.

When the undercoat layer according to the present invention is dispersed in a solvent that can dissolve the binder resin binding the undercoat layer to prepare a dispersion, the absorbance of the dispersion has specific physical properties. In this case, the absorbance of the dispersion can be also measured as in the measurement of absorbance of the coating liquid for forming an undercoat layer of the electrophotographic photoreceptor according to the present invention.

When the dispersion is prepared by dispersing the undercoat layer according to the present invention, overlying layers, such as photosensitive layer, disposed on the undercoat layer are removed by dissolving the layers in a solvent that can dissolve these layers on the undercoat layer, but not substantially dissolve the binder resin binding the undercoat layer, and then the binder resin binding the undercoat layer is dissolved in a solvent. The solvent that can dissolve the undercoat layer preferably does not have high light absorption in the wavelength region of 400 nm to 1000 nm.

Examples of the solvent that can dissolve the undercoat layer include alcohols such as methanol, ethanol, 1-propanol, and 2-propanol. In particular, methanol, ethanol, and 1-propanol are preferred. These solvents may be used alone or in any combination of two or more kinds in any ratio.

The difference between the absorbance to light with 400 nm wavelength and the absorbance to light with 1000 nm wavelength (absorbance difference) of a dispersion dispersing the undercoat layer according to the present invention in a solvent mixture of methanol and 1-propanol at a weight ratio of 7:3 is as follows: For a refractive index of metal oxide particles of 2.0 or higher, the absorbance difference is usually 0.3 (Abs) or lower and preferably 0.2 (Abs) or lower. For a refractive index of metal oxide particles of lower than 2.0, the absorbance difference is usually 0.02 (Abs) or lower and preferably 0.01 (Abs) or lower.

The absorbance depends on the solid content of a liquid to be measured. Therefore, in the measurement of the absorbance, the concentration of the metal oxide particles dispersed in the dispersion is preferably adjusted to the range of 0.003 wt % to 0.0075 wt %.

The regular reflection rate of the undercoat layer according to the present invention usually shows a value specific to the present invention. The regular reflection rate of the undercoat layer according to the present invention means the rate of the regular reflection of an undercoat layer on an electroconductive support to that of the electroconductive support. Since the regular reflection rate of the undercoat layer varies depending on the thickness of the undercoat layer, the reflectance here is defined as that when the thickness of the undercoat layer is 2 μm.

In the undercoat layer according to the present invention, for a refractive index of the metal oxide particles contained in the undercoat layer of 2.0 or higher, the ratio of the regular reflectance of 480 nm light on the undercoat layer to the regular reflectance of 480 nm light on the electroconductive support is usually 50% or higher, where the ratio is converted into that of the undercoat layer with a thickness of 2 μm.

On the other hand, for a refractive index of the metal oxide particles contained in the undercoat layer of lower than 2.0, the ratio of the regular reflectance of 400 nm light on the undercoat layer to the regular reflectance of 400 nm light on the electroconductive support is usually 50% or higher, where the ratio is converted into that of the undercoat layer with a thickness of 2 μm.

Here, even if the undercoat layer contains different types of metal oxide particles with refractive indices of 2.0 or higher or different types of metal oxide particles with refractive indices lower than 2.0, the regular reflection rate is preferably in the above-mentioned range. Furthermore, even if the undercoat layer contains both metal oxide particles with a refractive index of 2.0 or higher and metal oxide particles with a refractive index lower than 2.0, as in the case of the undercoat layer containing metal oxide particles with a refractive index of 2.0 or higher, the ratio of the regular reflection of 480 nm light on the undercoat layer to the regular reflection of 480 nm light on the electroconductive support is preferably in the above-mentioned range (50% or higher), where the regular reflection rate is converted into that of the undercoat layer with a thickness of 2 μm.

Hitherto, cases of the undercoat layer having a thickness of 2 μm are described in detail. In the electrophotographic photoreceptor according to the present invention, however, the thickness of the undercoat layer is not limited to 2 μm and may have any thickness. In the case of the undercoat layer having a thickness other than 2 μm, the regular reflection rate can be measured using the coating liquid for forming an undercoat layer that is used for forming the undercoat layer and forming an undercoat layer having a thickness of 2 μm on an electroconductive support equivalent to the electrophotographic photoreceptor and measuring the regular reflection rate of this undercoat layer. Alternatively, the regular reflection rate of the undercoat layer of the electrophotographic photoreceptor is measured, and then the regular reflection rate may be converted into that of an undercoat layer with a thickness of 2 μm.

A conversion process will be described below.

A layer having a small thickness dL and being perpendicular to the light is supposed for the detection of specific monochromatic light that passes through the undercoat layer, is regularly reflected on the electroconductive support, and then passes again through the undercoat.

A decrease in intensity −dI of the light that passed through the layer with a thickness dL is proportional to the intensity I before the light passes through the layer and the layer thickness dL, as is expressed by the equation (k is a constant) below.

$$-dI=kIdL \quad \text{(B).}$$

Equation (B) can be modified as follows:

$$-dI/I=kdL \quad \text{(C).}$$

By integrating both sides of Equation (C) over the intervals from $I_0$ to I and from 0 to L, respectively, the following equation is obtained. Here, $I_0$ represents the intensity of the incident light.

$$\log(I_0/I)=kL \quad \text{(D).}$$

Equation (D) is identical to one called Lambert's law in a solution system and can be applied to measurement of the reflectance in the present invention.

Equation (D) can be modified as follows:

$$I=I_0 \exp(-kL) \quad \text{(E).}$$

The behavior of the incident light before it reaches the surface of an electroconductive support is represented by Equation (E).

The reflectance on the surface of a cylinder is represented by $R=I_1/I_0$ where $I_1$ represents the intensity of the reflected light, since the denominator of the regular reflection rate is reflected light of the incident light on the conductive support.

The light that reaches the surface of the electroconductive support in accordance with Equation (E) is regularly reflected after being multiplied by the reflectance R and then passes through the optical path L again toward the surface of the undercoat layer. That is, the following expression is obtained:

$$I=I_0 \exp(-kL)\cdot R\cdot \exp(-kL) \quad \text{(F).}$$

$R=I_1/I_0$ is assigned and the equation is further modified to obtain a relationship:

$$I/I_1=\exp(-2kL) \quad \text{(G).}$$

This is the reflectance of the undercoat layer relative to the reflectance of the electroconductive support and is defined as the regular reflection rate.

As described above, in the case of a 2 μm undercoat layer, the to-and-fro optical path length is 4 μm, and the reflectance T of the undercoat layer on an optional electroconductive support is a function of the thickness L of the undercoat layer (in this case, the optical path length is 2 L) and is represented by T(L). From Equation (G), the following equation is obtained:

$$T(L)=I/I_1=\exp(-2kL) \quad \text{(H).}$$

Furthermore, since the value that should be determined is T(2), L=2 is assigned to Equation (H) to obtain:

$$T(2)=I/I_1=\exp(-4k) \quad \text{(I),}$$

and k is deleted by Equations (H) and (I) to obtain:

$$T(2)=T(L)^{2/L} \quad \text{(J).}$$

That is, at a thickness L (μm) of the undercoat layer, the reflectance T(2) for an undercoat layer of 2 μm thickness can be estimated with considerable accuracy by measuring the reflectance T(L) of the undercoat layer. The thickness L of the undercoat layer can be measured by any film thickness measuring apparatus such as a roughness meter.

[IV-3. Photosensitive Layer]

[IV-3-1. Charge-Generating Layer]

The charge-generating material used in the electrophotographic photoreceptor of the present invention can be any conventional material that has been applied to this use. Examples of such a material include azo pigments, phthalocyanine pigments, anthanthrone pigments, quinacridone pigments, cyanine pigments, pyrylium pigments, thiapyrylium pigments, indigo pigments, polycyclic quinone pigments, and squaric acid pigments. Among them, preferred are phthalocyanine pigments and azo pigments. The phthalocyanine pigments can give photoreceptors with high sensitivity to laser light having a relatively long wavelength, and the azo pigments have sufficient sensitivity to white light and laser light having a relatively short wavelength. Thus, these pigments are excellent.

In the present invention, high efficiency is achieved by using the phthalocyanine compounds as a charge-generating material, which is preferable. Examples of the phthalocyanine compounds include metal-free phthalocyanine and phthalocyanines with which metals such as copper, indium, gallium, tin, titanium, zinc, vanadium, silicon, and germanium, or oxides thereof, halides thereof, hydroxides thereof, or alkoxides thereof are coordinated.

Furthermore, the phthalocyanine compounds may have any crystal form, and, preferred are crystal forms with high-sensitivity, e.g., metal-free phthalocyanines of X-type and τ-type, titanyl phthalocyanine (alias: oxytitanium phthalocyanine) such as A-type (alias: β-type), B-type (alias: α-type), and D-type (alias: Y-type), vanadyl phthalocyanine, chloroindium phthalocyanine, chlorogallium phthalocyanine such as II-type, hydroxygallium phthalocyanine such as V-type, μ-oxo-gallium phthalocyanine dimer such as G-type and I-type, and μ-oxo-aluminum phthalocyanine dimer such as II-type. Among these phthalocyanines, particularly preferred are A-type (β-type), B-type (α-type), and D-type (Y-type) titanyl phthalocyanines, II-type chlorogallium phthalocyanine, V-type hydroxygallium phthalocyanine, and G-type μ-oxo-gallium phthalocyanine dimer.

Furthermore, among these phthalocyanine compounds, preferred are oxytitanium phthalocyanine showing a main diffraction peak at a Bragg angle (2θ±0.2°) of 27.3° in an X-ray diffraction spectrum to CuKα characteristic X-rays, oxytitanium phthalocyanine showing main diffraction peaks at 9.3°, 13.20, 26.2°, and 27.1°, dihydroxysilicone phthalocyanine showing main diffraction peaks at 9.2°, 14.1°, 15.3°, 19.7°, and 27.1°, dichlorotin phthalocyanine showing main diffraction peaks at 8.5°, 12.2°, 13.8°, 16.9°, 22.4°, 28.4°, and 30.1°, hydroxygallium phthalocyanine showing main diffraction peaks at 7.5°, 9.9°, 12.5°, 16.3°, 18.6°, 25.1°, and 28.3°, and chlorogallium phthalocyanine showing diffraction peaks at 7.4°, 16.6°, 25.5°, and 28.3°. Among them, oxytitanium phthalocyanine showing a main diffraction peak at 27.3° is particularly preferred, and oxytitanium phthalocyanine showing main diffraction peaks at 9.5°, 24.1°, and 27.3° is particularly preferred.

The charge-generating materials may be used alone or in any combination of two or more kinds in any ratio. Accordingly, the above-mentioned phthalocyanine compounds may be used alone or in a mixture of two or more kinds or in a mixed crystal state thereof. Here, the mixture or the mixed crystal state of the phthalocyanine compounds may be prepared by mixing respective constituents afterwards or by causing the mixed state in any production or treatment process of the phthalocyanine compounds, such as synthesis, pigment formation, or crystallization. Examples of such treatment are acid-paste treatment, milling treatment, and solvent treatment. To cause a mixed crystal state, for example, as described in Japanese Unexamined Patent Application Publication No. Hei 10-48859, two different crystals are mixed and are then mechanically milled into an amorphous state, and then the mixture is converted into a specific crystal state by solvent treatment.

In the case using the phthalocyanine compound, a charge-generating material other than the phthalocyanine compound may be simultaneously used. Examples of such a charge-generating material include azo pigments, perylene pigments, quinacridone pigments, polycyclic quinone pigments, indigo pigments, benzimidazole pigments, pyrylium salts, thiapyrylium salts, and squarium salts.

The charge-generating material is dispersed in a coating liquid for forming a photosensitive layer, and the charge-generating material may be preliminarily pulverized before being dispersed in the coating liquid for forming a photosensitive layer. The pre-pulverization may be carried out with any apparatus, and is usually carried out with, for example, a ball mill or a sand grind mill. The pulverizing medium to be applied to these pulverizers may be any medium that will not be powdered during the pulverization treatment and it can be easily separated after the dispersion treatment. Examples of such a medium include beads and balls of glass, alumina, zirconia, stainless steel, or ceramic. In the pre-pulverization, the charge-generating material is pulverized into a volume average particle diameter of preferably 500 μm or smaller and more preferably 250 μm or smaller. The volume average particle diameter of the charge-generating material may be measured by any method that is usually used by those skilled in the art, but is usually measured by a sedimentation method or a centrifugal sedimentation method.

[IV-3-2. Charge-Transporting Material]

Any charge-transporting material can be used. Examples of the charge-transporting material include polymer compounds such as polyvinyl carbazole, polyvinyl pyrene, polyglycidyl carbazole, and polyacenaphthylene; polycyclic aromatic compounds such as pyrene and anthracene; heterocyclic compounds such as indol derivatives, imidazole derivatives, carbazole derivatives, pyrazole derivatives, pyrazoline derivatives, oxadiazole derivatives, oxazole derivatives, and thiadiazole derivatives; hydrazone compounds such as p-diethylaminobenzaldehyde-N,N-diphenylhydrazone and N-methylcarbazole-3-carbaldehyde-N,N-diphenylhydrazone; styryl compounds such as 5-(4-(di-p-tolylamino) benzylidene)-5H-dibenzo(a,d)cycloheptene; triarylamine compounds such as p-tritolylamine; benzidine compounds such as N,N,N',N'-tetraphenylbenzidine; butadiene compounds; and triphenylmethane compounds such as di-(p-ditolylaminophenyl)methane. Among them, preferred are hydrazone derivatives, carbazole derivatives, styryl compounds, butadiene compounds, triarylamine compounds, benzidine compounds, and products produced by bonding some of these compounds. These charge-transporting materials may be used alone or in any combination of two or more kinds in any ratio.

[IV-3-3. Binder Resin for Photosensitive Layer]

The photosensitive layer of the electrophotographic photoreceptor of the present invention is formed such that a photoconductive material is bound with a binder resin. Any known binder resin used in electrophotographic photoreceptors can be used as the binder resin for a photosensitive layer. Examples of the binder resin for a photosensitive layer include polymethylmethacrylate, polystyrene, polyvinyl acetate, polyacrylic acid esters, polymethacrylic acid esters, polyesters, polyarylates, polycarbonates, polyester polycarbonates, polyvinyl acetal, polyvinyl acetacetal, polyvinyl propional, polyvinyl butyral, polysulfones, polyimides, phenoxy resins, epoxy resins, urethane resins, silicone resins, cellulose esters, cellulose ethers, vinyl chloride-vinyl acetate copolymers, and vinyl polymers such as polyvinyl chloride; copolymers thereof; and partially cross-linked hardened products thereof. The binder resins for a photosensitive layer may be used alone or in any combination of two or more kinds at any ratio.

[IV-3-4. Layer Containing Charge-Generating Material]

Multilayered Photoreceptor

In the case that the electrophotographic photoreceptor of the present invention is a so-called multilayered photoreceptor, the layer containing a charge-generating material is usually a charge-generating layer. However, in the multilayered photoreceptor, the charge-transporting layer may contain a charge-generating material as long as the effects of the present invention are not significantly impaired.

The charge-generating material may have any volume average particle diameter, but is usually 1 μm or less and preferably 0.5 μm or less in the case of the multilayered photoreceptor. The volume average particle diameter of the charge-generating material can be measured by a laser diffraction scattering method or a light-transmission centrifugal sedimentation method, as well as the above-described dynamic light-scattering method.

The thickness of the charge-generating layer is not limited, but is usually 0.1 μm or more and preferably 0.15 μm or more and usually 2 μm or less and preferably 0.8 μm or less.

In the case that the layer containing the charge-generating material is a charge-generating layer, the amount of the charge-generating material used in the charge-generating layer is usually 30 parts by weight or more and preferably 50 parts by weight or more and usually 500 parts by weight or less and preferably 300 parts by weight or less on the basis of 100 parts by weight of the binder resin for a photosensitive layer contained in the charge-generating layer. A smaller amount of the charge-generating material may cause unsatisfactory electric characteristics of the resulting electrophotographic photoreceptor. A larger amount may deteriorate the stability of the coating liquid.

In addition, the charge-generating layer may contain a known plasticizer for improving film-forming characteristics, flexibility, mechanical strength, and other properties, an additive suppressing residual potential, a dispersion aid for improving dispersion stability, a leveling agent for improving the coating characteristics, a surfactant, a silicone oil, a fluorine-based oil, and other additive. These additives may be used alone or in any combination of two or more kinds in any ratio.

Single-Layer Photoreceptor

In the case that the electrophotographic photoreceptor of the present invention is a so-called single-layer photoreceptor, the charge-generating material is dispersed in a matrix that contains a binder resin and a charge-transporting material for a photosensitive layer as main components with a blending ratio similar to that of the charge-transporting layer described below.

In the case of the single photosensitive layer, the charge-generating material desirably has a sufficiently small particle diameter. Accordingly, the volume average particle diameter of the charge-generating material in the single photosensitive layer is usually 0.5 μm or less, preferably 0.3 μm or less, and particularly preferably 0.15 μm or less. The thickness of the single photosensitive layer is not limited, but is usually 5 μm or more and preferably 10 μm or more and usually 5 μm or less and preferably 45 μm or less.

The amount of the charge-generating material dispersed in the photosensitive layer is not limited, but a smaller amount may cause insufficient sensitivity and a larger amount may cause a decrease in charging performance and a decrease in sensitivity. Accordingly, the amount of the charge-generating material in the single photosensitive layer is usually 0.5 wt % or more and preferably 10 wt % or more and usually 50 wt % or less and preferably 45 wt % or less.

In addition, the photosensitive layer of the single-layer photoreceptor also may contain a known plasticizer for improving film-forming characteristics, flexibility, mechanical strength, and other properties, an additive suppressing residual potential, a dispersion aid for improving dispersion stability, a leveling agent for improving the coating characteristics, a surfactant, a silicone oil, a fluorine-based oil, and other additives. These additives may be used alone or in any combination of two or more kinds in any ratio.

[IV-3-5. Layer Containing Charge-Transporting Material]

In the case that the electrophotographic photoreceptor of the present invention is a so-called multilayered photoreceptor, the layer containing a charge-transporting material is usually a charge-transporting layer. The charge-transporting layer may be made of only a resin having a charge-transporting function, but it is preferably made of a binder resin for a photosensitive layer dispersing or dissolving the charge-transporting material.

The charge-transporting layer may have any thickness, but is usually 5 μm or more, preferably 10 μm or more, and more preferably 15 μm or more and usually 60 μm or less, preferably 45 μm or less, and more preferably 27 μm or less.

In the case that the electrophotographic photoreceptor of the present invention is a so-called single-layer photoreceptor, the single photosensitive layer is made of a binder resin dispersing or dissolving a charge-transporting material as a matrix dispersing the charge-transporting material.

The binder resin used in the layer containing the charge-transporting material may be the above-mentioned binder resins for a photosensitive layer. Among them, examples of the binder resin that is particularly preferred in the layer containing the charge-transporting material include polymethylmethacrylate, polystyrene, vinyl polymers such as polyvinyl chloride, and copolymers thereof; polycarbonates, polyarylates, polyesters, polyester carbonates, polysulfones, polyimides, phenoxy resins, epoxy resins, and silicone resins; and partially cross-linked hardened products thereof. These binder resins may be used alone or in any combination of two or more kinds at any ratio.

The ratio of the charge-transporting material to the binder resin in the charge-transporting layer and the single photosensitive layer is not limited as long as the effects of the present invention are not significantly impaired, and the amount of the charge-transporting material is usually 20 parts by weight or more, preferably 30 parts by weight or more, and more preferably 40 parts by weight or more and usually 200 parts by weight or less, preferably 150 parts by weight or less, and more preferably 120 parts by weight or less, on the basis of 100 parts by weight of the binder resin.

In addition, the layer containing the charge-transporting material may optionally contain any additive, for example, an antioxidant such as hindered phenol or hindered amine, an ultraviolet absorber, a sensitizer, a leveling agent, or an electron-attractive compound. These additives may be used alone or in any combination of two or more kinds in any ratio.

[IV-3-6. Other Layers]

The electrophotographic photoreceptor of the present invention may include any other layer, in addition to the undercoat layer and the photosensitive layer.

An example of the other layer may be an outermost layer, for example, a known surface protection layer or overcoat layer having a main component of a thermoplastic or thermosetting polymer.

[IV-3-7. Method for Forming Layer]

Layers other than the undercoat layer of the photoreceptor may be formed by any method without limitation. For example, as in the formation of the undercoat layer with the coating liquid for forming an undercoat layer of the present invention, the layers are formed in series by repeating the coating and drying steps of coating liquids, which are prepared by dissolving or dispersing materials to be contained in each layer (such as a coating liquid for forming a photosensitive layer, a coating liquid for forming a charge-generating layer, or a coating liquid for forming a charge-transporting layer) in a solvent, by a known coating method, such as dip coating, spray coating, or ring coating. In this case, the coating liquid may contain any additive, such as a leveling agent, an antioxidant, or a sensitizer, according to need for improving the coating characteristics.

The solvent used in the coating liquid is not limited, but, in general, an organic solvent is used. Preferable examples of the solvent include alcohols such as methanol, ethanol, propanol, 1-hexanol, and 1,3-butanediol; ketones such as acetone, methyl ethyl ketone, methyl isobutyl ketone, and cyclohexanone; ethers such as dioxane, tetrahydrofuran, and ethylene glycol monomethyl ether; ether ketones such as 4-methoxy-4-methyl-2-pentanone; (halo) aromatic hydrocarbons such as benzene, toluene, xylene, and chlorobenzene; esters such as methyl acetate and ethyl acetate; amides such as N,N-dimethylformamide and N,N-dimethylacetamide; and sulfoxides such as dimethyl sulfoxide. Among these solvents, preferably used are alcohols, aromatic hydrocarbons, ethers, and ether ketones, and more preferably used are toluene, xylene, 1-hexanol, 1,3-butanediol, tetrahydrofuran, and 4-methoxy-4-methyl-2-pentanone.

The solvents may be used alone or in any combination of two or more kinds in any ratio. Examples of solvents that are preferably used in combination include ethers, alcohols, amides, sulfoxides, and ether ketones. Among them, preferred are ethers such as 1,2-dimethoxyethane and alcohols such as 1-propanol. In particular, ethers are preferred, from the viewpoints of crystal form stability and dispersion stability of the phthalocyanine when the coating liquid is prepared using oxytitanium phthalocyanine as the charge-generating material.

The amount of the solvent used in the coating liquid is not limited, and may be suitably determined depending on the composition of the coating liquid and the coating process.

[IV-3-8. Advantage of Electrophotographic Photoreceptor of the Present Invention]

The electrophotographic photoreceptor of the present invention forms an image with high quality even under various operation conditions. Also, the electrophotographic photoreceptor exhibits excellent duration stability and hardly causes image defects, such as black spots and color spots. Therefore, when the electrophotographic photoreceptor of the present invention is used for forming an image, a high-quality image is formed, with suppressed environmental effect.

In conventional electrophotographic photoreceptors, the undercoat layer contains huge agglomerates of the metal oxide particles. Such huge agglomerates of the metal oxide particles may cause defects in an image formed. Furthermore, in the case using contact-type charging means, charge may migrate from the photosensitive layer to the electroconductive support through the metal oxide particles when the photosensitive layer is charged, and thereby the charging may be improperly conducted. However, since the electrophotographic photoreceptor of the present invention includes an undercoat layer containing metal oxide particles having a very small average particle diameter and a suitable particle size distribution, occurrence of defects and improper charging are suppressed to enable the formation of a high-quality image.

[V. Image-Forming Apparatus]

Regarding an embodiment of an image-forming apparatus (image-forming apparatus of the present invention) including the electrophotographic photoreceptor of the present invention, the main structure of the apparatus will now be described with reference to FIG. 1. However, the embodiment is not limited to the following description, and various modifications can be conducted within the scope of the present invention.

As shown in FIG. 1, the image-forming apparatus includes an electrophotographic photoreceptor 1, a charging device (charging means) 2, an exposure device (exposure means; image exposure means) 3, a development device (development means) 4, and a transfer device (transfer means) 5. Furthermore, the image-forming apparatus optionally includes a cleaning device (cleaning means) 6 and a fixation device (fixation means) 7.

The photoreceptor 1 of the image-forming apparatus of the present invention is the above-described electrophotographic photoreceptor of the present invention. That is, in the image-forming apparatus of the present invention including an electrophotographic photoreceptor, charging means for charging the electrophotographic photoreceptor, image exposure means for forming an electrostatic latent image by subjecting the charged electrophotographic photoreceptor to image exposure, development means for developing the electrostatic latent image with toner, and transfer means for transferring the toner to a transfer object, the electrophotographic photoreceptor includes an undercoat layer containing a binder resin and metal oxide particles on an electroconductive support, and a photosensitive layer disposed on the undercoat layer; and the metal oxide particles have a cumulative volume average diameter D50' of 0.1 μm or less and a volume particle size distribution width index SD' satisfying Expression (3) which are measured by a dynamic light-scattering method in a liquid containing the undercoat layer dispersed in a solvent mixture of methanol and 1-propanol at a weight ratio of 7:3. The volume particle size distribution width index SD' here more preferably satisfies the above-mentioned Expression (4).

The investigation of the present inventors has revealed that when the cumulative volume average diameter D50' and the volume particle size distribution width index SD' do not satisfy the above-mentioned ranges, the resulting photoreceptor exhibits unstable repeated exposure-charge characteristics at low temperature and low humidity. Consequently, image defects, such as black spots and color spots, frequently occur in images formed with the image-forming apparatus, which may cause unclear and unstable image formation by the image-forming apparatus.

The electrophotographic photoreceptor 1 is the above-described electrophotographic photoreceptor of the present invention without any additional requirement. FIG. 1 shows, as such an example, a drum photoreceptor having the above-described photosensitive layer on the surface of a cylindrical electroconductive support. Along the outer surface of this electrophotographic photoreceptor 1, a charging device 2, an exposure device 3, a development device 4, a transfer device 5, and a cleaning device 6 are arranged.

The charging device 2 charges the electrophotographic photoreceptor 1 such that the surface of the electrophotographic photoreceptor 1 is uniformly charged to a predetermined potential. It is preferable that the charging device be in contact with the electrophotographic photoreceptor 1 in order to efficiently utilize the effects of the present invention. FIG. 1 shows a roller charging device (charging roller) as an example of the charging device 2, but other charging devices, for example, corona charging devices such as corotron or scorotron and contacting charging devices such as a charging brush, are widely used.

In many cases, the electrophotographic photoreceptor 1 and the charging device 2 are integrated into a cartridge (hereinafter, optionally, referred to as "photoreceptor cartridge") that is detachable from the body of an image-forming apparatus. When the electrophotographic photoreceptor 1 or the charging device 2 are degraded, the photoreceptor cartridge can be replaced with a new one by detaching the used photoreceptor cartridge from the image-forming apparatus body and attaching the new one to the image-forming apparatus body. In addition, in many cases, toner described below is also stored in a toner cartridge detachable from an image-forming apparatus body. When the toner in the toner cartridge is exhausted in use, the toner cartridge can be detached from the image-forming apparatus body, and a new toner cartridge can be attached to the apparatus body. Furthermore, a cartridge including all the electrophotographic photoreceptor 1, the charging device 2, and the toner may be used.

The exposure device 3 may be of any type that can form an electrostatic latent image on a photosensitive surface of the electrophotographic photoreceptor 1 by exposure (image exposure) to the electrophotographic photoreceptor 1, and examples thereof include halogen lamps, fluorescent lamps, lasers such as a semiconductor laser and a He-Ne laser, and LEDs (light-emitting diodes). Furthermore, the exposure may be conducted by a photoreceptor internal exposure system. Any light can be used for the exposure. For example, the exposure may be carried out with monochromatic light having a wavelength of 780 nm; monochromatic light having a slightly shorter wavelength of 600 nm to 700 nm; or monochromatic light having a shorter wavelength of 350 nm to 600 nm. Among them, the exposure is preferably carried out with monochromatic light having a short wavelength of 350 nm to 600 nm and more preferably a wavelength of 350 nm to 500 nm.

The development device 4 develops the electrostatic latent image. The development device 4 may be of any type, and examples thereof include dry development systems such as cascade development, one-component conductive toner development, and two-component magnetic brush development; and wet development systems. The development device 4 shown in FIG. 1 includes a development tank 41, agitators 42, a supply roller 43, and a development roller 44, a control member 45, and has a structure in which the development tank 41 contains toner T. In addition, the development device 4 may be provided with an optional refill device (not shown) for refilling the toner T. This refill device can refill the development tank 41 with toner T from a container such as a bottle or a cartridge.

The supply roller 43 is made of, for example, an electroconductive sponge. The development roller 44 is, for example, a metal roller made of, e.g., iron, stainless steel, aluminum, or nickel or a resin roller made of such a metal roller coated with, e.g., a silicone resin, a urethane resin, or a fluorine resin. The surface of this development roller 44 may be optionally smoothed or roughened.

The development roller 44 is arranged between the electrophotographic photoreceptor 1 and the supply roller 43 and abuts on both the electrophotographic photoreceptor 1 and the supply roller 43. The supply roller 43 and the development roller 44 are rotated by a rotary drive mechanism (not shown).

The supply roller 43 carries the toner T stored and supplies it to the development roller 44. The development roller 44 carries the toner T supplied from the supply roller 43 and brings it into contact with the surface of the electrophotographic photoreceptor 1.

The control member 45 is made of, for example, a resin blade of, e.g., a silicone resin or a urethane resin; a metal blade of, e.g., stainless steel, aluminum, copper, brass, or phosphor bronze; or a blade made of such a metal blade coated with a resin. The control member 45 abuts on the development roller 44 and is biased toward the development roller 44 at a predetermined force (a usual blade line pressure is 5 to 500 g/cm) with, for example, a spring. The control member 45 may have an optional function charging the toner T by frictional electrification.

The agitators 42 are each rotated by a rotary drive mechanism and agitate the toner T and transfer it to the supply roller 43. The blade shapes and sizes of the agitators 42 may be different from each other.

The toner T may be of any type, and polymerized toner prepared by suspension polymerization or emulsion polymerization, as well as powder toner, can be used. In the use of the polymerized toner, a small particle diameter of about 4 to 8 μm is particularly preferred, and various shapes of toner may be used from a spherical shape to a non-spherical shape such as a potato-like shape. The polymerized toner exhibits superior charging uniformity and transferring characteristics and, therefore, can be suitably used for forming an image with higher quality.

The transfer device 5 may be of any type, and devices employing, for example, electrostatic transfer such as corona transfer, roller transfer, or belt transfer; pressure transfer; or adhesive transfer can be used. The transfer device 5 here includes a transfer charger, a transfer roller, and a transfer belt that are arranged so as to face the electrophotographic photoreceptor 1. The transfer device 5 transfers a toner image formed in the electrophotographic photoreceptor 1 to a transfer material (transfer object, paper, medium) P by a predetermined voltage (transfer voltage) with a polarity opposite to that of the charged potential of the toner T. In the present invention, it is effective that the transfer device 5 be in contact with the photoreceptor via the transfer material.

The cleaning device 6 may be of any type, and examples thereof include a brush cleaner, a magnetic brush cleaner, an electrostatic brush cleaner, a magnetic roller cleaner, and a blade cleaner. The cleaning device 6 collects remaining toner adhering to the photoreceptor 1 by scraping the remaining toner with a cleaning member. The cleaning device 6 is unnecessary when the amount of toner remaining on the surface of the photoreceptor is small or substantially zero.

The fixation device 7 is composed of an upper fixation member (fixation roller) 71 and a lower fixation member (fixation roller) 72, and the fixation member 71 or 72 is provided with a heating device 73 therein. FIG. 1 shows an example of the heating device 73 provided inside the upper fixation member 71. The upper and lower fixation members 71 and 72 may be known thermal fixation members, for example, a fixation roller in which a pipe of a metal material, such as stainless steel or aluminum, is coated with a silicone rubber, a fixation roller further having a fluorine resin coating, or a fixation sheet. The upper and lower fixation members 71 and 72 may have a structure for supplying a mold-releasing agent, such as a silicone oil, for improving mold release properties or may have a structure for applying a pressure to each other with, for example, a spring.

The toner transferred onto a recording paper P is heated to be melted when passing through between the upper fixation member 71 and the lower fixation member 72 that are heated to a predetermined temperature, and then is fixed on the recording paper P by cooling thereafter.

The fixation device may be of any type, and examples thereof include, in addition to that described here, devices employing a system of heat roller fixation, flash fixation, oven fixation, or pressure fixation.

In the electrophotographic apparatus having a structure described above, an image is recorded as follows: The surface (photosensitive surface) of the photoreceptor 1 is charged to a predetermined potential (for example, −600 V) with the charging device 2. The charging may be conducted by a direct-current voltage or by a direct-current voltage superimposed by an alternating-current voltage.

Subsequently, the charged photosensitive surface of the photoreceptor 1 is exposed with the exposure device 3 depending on the image to be recorded. Thereby, an electrostatic latent image is formed in the photosensitive surface. This electrostatic latent image formed in the photosensitive surface of the photoreceptor 1 is developed by the development device 4.

In the development device 4, the toner T supplied by the supply roller 43 is spread into a thin layer with the control member (developing blade) 45 and, simultaneously, is charged by friction so as to have a predetermined polarity (here, the toner is charged into negative polarity, which is the same as the polarity of the charge potential of the photoreceptor 1). This toner T is held on the development roller 44 and is conveyed and brought into contact with the surface of the photoreceptor 1.

The charged toner T held on the development roller 44 comes into contact with the surface of the photoreceptor 1, so that a toner image corresponding to the electrostatic latent image is formed on the photosensitive surface of the photoreceptor 1. This toner image is transferred to a recording paper P with the transfer device 5. Thereafter, the toner remaining on the photosensitive surface of the photoreceptor 1 without being transferred is removed with the cleaning device 6.

After the transfer of the toner image to the recording paper P, the recording paper P passes through the fixation device 7 to thermally fix the toner image on the recording paper P. Thereby, an image is finally recorded.

The image-forming apparatus may have a structure that can conduct, for example, a charge elimination step, in addition to the above-described structure. The charge elimination step neutralizes the electrophotographic photoreceptor by exposing the electrophotographic photoreceptor with light. Examples of such a device for the charge elimination include fluorescent lamps and LEDs. In many cases, the light used in the charge elimination step has an exposure energy intensity at least 3 times that of the exposure light.

The structure of the image-forming apparatus may be further modified. For example, the image-forming apparatus may have a structure that conducts steps such as a pre-exposure step and a supplementary charging step, that performs offset printing, or that includes a full-color tandem system using different toners.

Furthermore, it is preferable that the cartridge include, instead of the charging device 2 or in addition to the charging device 2, one or more of the exposure device 3, the development device 4, the transfer device 5, the cleaning device 6, and the fixation device 7 in combination with the photoreceptor 1. That is, the photoreceptor 1 and at least one of the charging device 2, the exposure device 3, the development device 4, the transfer device 5, the cleaning device 6, and the fixation device 7 may be combined into an integrated cartridge (electrophotographic cartridge) that is detachable from an electrophotographic apparatus such as a copier or a laser beam printer. That is, in the electrophotographic cartridge of the present invention including the electrophotographic photoreceptor and at least one of the charging means for charging the electrophotographic photoreceptor, the image exposure means for forming an electrostatic latent image by subjecting the charged electrophotographic photoreceptor to image exposure, the development means for developing an electrostatic latent image formed in the electrophotographic photoreceptor with toner, the transfer means for transferring the toner to a transfer object, the fixing means for fixing the toner transferred to the transfer object, and the cleaning means for recovering the toner adhering to the electrophotographic photoreceptor, the electrophotographic photoreceptor includes an undercoat layer containing a binder resin and metal oxide particles on an electroconductive support, and a photosensitive layer disposed on the undercoat layer; and the metal oxide particles have a cumulative volume average diameter D50' of 0.1 μm or less and a volume particle size distribution width index SD' satisfying Expression (3) which are measured by a dynamic light-scattering method in a liquid containing the undercoat layer dispersed in a solvent mixture of methanol and 1-propanol at a weight ratio of 7:3. The volume particle size distribution width index SD' here more preferably satisfies the above-mentioned Expression (4). In particular, when the charging means is in contact with the electrophotographic photoreceptor, the effects of the present invention are significantly achieved. Such an arrangement is thus desirable.

The investigation of the present inventors has revealed that when the cumulative volume average diameter D50' and the volume particle size distribution width index SD' do not satisfy the above-mentioned ranges, the resulting photoreceptor exhibits unstable repeated exposure-charge characteristics at low temperature and low humidity. Consequently, image defects, such as black spots and color spots, frequently occur in images formed with the electrophotographic cartridge, which may cause unclear and unstable image formation by the electrophotographic cartridge.

In this case, as in the cartridge described in the above embodiment, for example, even if the electrophotographic photoreceptor 1 or another member is deteriorated, the maintenance of an image-forming apparatus can be readily performed by detaching the electrophotographic cartridge from the image-forming apparatus body and attaching a new electrophotographic cartridge to the image-forming apparatus body.

The image-forming apparatus and the electrophotographic cartridge of the present invention are capable of forming a high-quality image. In particular, the image-forming apparatus and the electrophotographic cartridge of the present invention hardly cause quality deterioration even if the transfer device 5 is in contact with the photoreceptor via a transfer material, though the quality of an image is readily deteriorated in conventional apparatuses. Thus, the image-forming apparatus and the electrophotographic cartridge of the present invention are effective.

[VI. Main Advantages of the Present Invention]

According to the present invention, at least one of advantages described below is achieved.

That is, according to the present invention, the coating liquid for forming an undercoat layer is stabilized without gelation and precipitation of dispersed titanium oxide particles, therefore enabling long storage and use. Furthermore, the coating liquid exhibits reduced changes in physical properties, such as viscosity in use. Consequently, when photosensitive layers are continuously formed on supports by applying and drying the coating liquid, the resulting photosensitive layers have a uniform thickness.

Furthermore, an electrophotographic photoreceptor including an undercoat layer formed with the coating liquid prepared by the method for preparing a coating liquid for forming an undercoat layer of the present invention exhibits stable electric characteristics even under low temperature and low humidity, thus having excellent electric characteristics.

Accordingly, an image-forming apparatus including the electrophotographic photoreceptor of the present invention forms a satisfactory image having significantly reduced image defects such as black spots and color spots. In particular, an image-forming apparatus in which charging is conducted by charging means arranged in contact with the electrophotographic photoreceptor forms a satisfactory image having significantly reduced image defects such as black spots and color spots.

Furthermore, an image-forming apparatus including the electrophotographic photoreceptor of the present invention and using light with a wavelength of 350 nm to 600 nm in the image exposure means exhibits a high initial charging potential and high sensitivity, which enables to form a high-quality image.

EXAMPLES

The present invention will now be further specifically described with reference to Examples and Comparative Examples, but is not limited thereto within the scope of the present invention. In the description of Examples, the term "part(s)" means "part(s) by weight" unless otherwise specified.

Example 1

Surface-treated titanium oxide was prepared by mixing rutile titanium oxide having an average primary particle diameter of 40 nm ("TT055N", manufactured by Ishihara Sangyo Co., Ltd.) and methyldimethoxysilane ("TSL8117", manufactured by Toshiba Silicone Co., Ltd.) in an amount of 3 wt % on the basis of the amount of the titanium oxide with a Henschel mixer. One kilogram of raw material slurry composed of a mixture of 50 parts of the surface-treated titanium oxide and 120 parts of methanol was subjected to dispersion treatment for 1 hour using zirconia beads with a diameter of about 100 μm (YTZ, manufactured by Nikkato Corp.) as a dispersion medium and an Ultra Apex Mill (model UAM-015, manufactured by Kotobuki Industries Co., Ltd.) having a mill capacity of about 0.15 L under liquid circulation conditions of a rotor peripheral velocity of 10 m/second and a liquid flow rate of 10 kg/hour to give a titanium oxide dispersion.

The titanium oxide dispersion, a solvent mixture of methanol/1-propanol/toluene, and a pelletized polyamide copolymer composed of ∈-caprolactam [compound represented by the following Formula (A)]/bis(4-amino-3-methylcyclohexyl)methane [compound represented by the following Formula (B)]/hexamethylene diamine [compound represented by the following Formula (C)]/decamethylenedicarboxylic acid [compound represented by the following Formula (D)]/octadecamethylenedicarboxylic acid [compound represented by the following Formula (E)] at a molar ratio of 60%/15%/5%/15%/5% were mixed with agitation under heat to dissolve the pelletized polyamide. The resulting solution was subjected to ultrasonic dispersion treatment for 1 hour with an ultrasonic oscillator at an output of 1200 W and then filtered through a PTFE membrane filter with a pore size of 5 μm (Mitex LC, manufactured by Advantech Co., Ltd.) to give a coating liquid A for forming an undercoat layer wherein the weight ratio of the surface-treated titanium oxide/copolymerized polyamide was 3/1, the weight ratio of methanol/1-propanol/toluene in the solvent mixture was 7/1/2, and the solid content was 18.0 wt %.

[Chemical Formula 4]

A

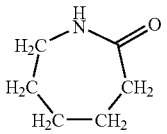

B

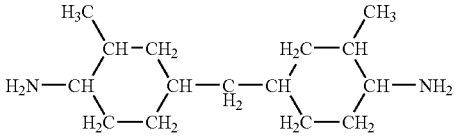

C

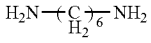

D

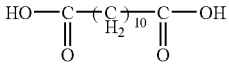

E

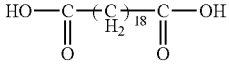

Regarding the coating liquid A for forming an undercoat layer, the rate of change in viscosity after storage for 120 days at room temperature compared to that immediately after the production (i.e., the value obtained by dividing a difference between the viscosity after storage for 120 days and the viscosity immediately after the production by the viscosity immediately after the production) and the particle size distribution of the titanium oxide particles immediately after the production were measured. The viscosity was measured by a method in accordance with JIS Z 8803 using an E-type viscometer (product name: ED, manufactured by Tokimec Inc.), and the particle size distribution was measured with the UPA. The results are shown in Table 2.

Example 2

A coating liquid B for forming an undercoat layer was prepared as in Example 1 except that the dispersion medium used for dispersion in the Ultra Apex Mill was zirconia beads having a diameter of about 50 μm (YTZ, manufactured by Nikkato Corp.), and the physical properties thereof were measured as in Example 1. The results are shown in Table 2.

Furthermore, the coating liquid B for forming an undercoat layer was diluted with a solvent mixture of methanol and 1-propanol=7/3 (weight ratio) such that the solid content was 0.015 wt % (metal oxide particle concentration: 0.011 wt %), and the difference between absorbance to light with 400 nm wavelength and the absorbance to light with 1000 nm wavelength of the diluted coating liquid was measured with a UV-visible spectrophotometer (UV-1650PC, manufactured by Shimadzu Corp.). The results are shown in Table 3.

Example 3

A coating liquid C for forming an undercoat layer was prepared as in Example 2 except that the rotor peripheral velocity of the Ultra Apex Mill was 12 m/second, and physical properties thereof were measured as in Example 1. The results are shown in Table 2.

Example 4

A coating liquid D for forming an undercoat layer was prepared as in Example 3 except that the dispersion medium used for dispersion in the Ultra Apex Mill was zirconia beads having a diameter of about 30 μm (YTZ, manufactured by Nikkato Corp.), and the physical properties thereof were measured as in Example 1. The results are shown in Table 2.

Example 5

A coating liquid E for forming an undercoat layer was prepared as in Example 2 except that the weight ratio of surface-treated titanium oxide/copolymerized polyamide was 2/1, and the difference between absorbance to light with 400 nm wavelength and the absorbance to light with 1000 nm wavelength thereof was measured as in Example 2 except that the solid content was 0.015 wt % (metal oxide particle concentration: 0.01 wt %). The results are shown in Table 3.

Example 6

A coating liquid F for forming an undercoat layer was prepared as in Example 2 except that the weight ratio of surface-treated titanium oxide/copolymerized polyamide was 4/1, and the difference between absorbance to light with 400 nm wavelength and the absorbance to light with 1000 nm wavelength thereof was measured as in Example 2 except that the solid content was 0.015 wt % (metal oxide particle concentration: 0.012 wt %). The results are shown in Table 3.

Example 7

A coating liquid G for forming an undercoat layer was prepared as in Example 2 except that aluminum oxide particles having an average primary particle diameter of 13 nm (Aluminium Oxide C, manufactured by Nippon Aerosil Co., Ltd.) were used instead of the surface-treated titanium oxide used in Example 1, the solid content contained was 8.0 wt %, and the weight ratio of aluminum oxide particle/copolymerized polyamide was 1/1, and the physical properties thereof were measured. The results are shown in Table 2.

The difference between absorbance to light with 400 nm wavelength and the absorbance to light with 1000 nm wavelength was measured as in Example 2 except that the coating liquid was diluted so that the solid content was 0.015 wt % (metal oxide particle concentration: 0.0075 wt %). The results are shown in Table 3.

Example 8

A coating liquid H for forming an undercoat layer was prepared as in Example 2 except that the weight ratio of surface-treated titanium oxide/copolymerized polyamide was 6/1, and the physical properties thereof were measured. The results are shown in Table 2.

Example 9

A coating liquid I for forming an undercoat layer was prepared as in Example 2 except that the weight ratio of surface-treated titanium oxide/copolymerized polyamide was 8/1, and the physical properties thereof were measured. The results are shown in Table 2.

Comparative Example 1

A coating liquid J for forming an undercoat layer was prepared as in Example 1 except that a dispersion slurry liquid prepared by mixing 50 parts of surface-treated titanium oxide and 120 parts of methanol and dispersing the mixture in a ball mill using alumina balls with a diameter of about 5 mm (HD, manufactured by Nikkato Corp.) for 5 hours was directly used without conducting the dispersion using the Ultra Apex Mill. The physical properties thereof were measured. The results are shown in Table 2.

Furthermore, the physical properties of the coating liquid J were measured as in Example 2 except that the solid content was 0.015 wt % (metal oxide particle concentration: 0.011 wt %). The results are shown in Table 3.

Comparative Example 2

A coating liquid K for forming an undercoat layer was prepared as in Comparative Example 1 except that zirconia balls with a diameter of about 5 mm (YTZ, manufactured by Nikkato Corp.) were used for ball mill dispersion in Comparative Example 1. The physical properties thereof were measured as in Example 1. The results are shown in Table 2.

Comparative Example 3

A coating liquid L for forming an undercoat layer was prepared as in Comparative Example 1 except that the weight ratio of surface-treated titanium oxide/copolymerized polyamide was 2/1, and the difference between absorbance to light with 400 nm wavelength and the absorbance to light with 1000 nm wavelength thereof was measured as in Example 2 except that the solid content was 0.015 wt % (metal oxide particle concentration: 0.01 wt %). The results are shown in Table 3.

Comparative Example 4

A coating liquid M for forming an undercoat layer was prepared as in Comparative Example 1 except that the weight ratio of surface-treated titanium oxide/copolymerized polyamide was 4/1, and the difference between absorbance to light with 400 nm wavelength and the absorbance to light with 1000 nm wavelength thereof was measured as in Example 2 except that the solid content was 0.015 wt % (metal oxide particle concentration: 0.012 wt %). The results are shown in Table 3.

Comparative Example 5

A coating liquid N for forming an undercoat layer was prepared as in Comparative Example 1 except that the weight ratio of surface-treated titanium oxide/copolymerized polyamide was 6/1.

Comparative Example 6

A coating liquid O for forming an undercoat layer was prepared as in Comparative Example 1 except that the weight ratio of surface-treated titanium oxide/copolymerized polyamide was 8/1.

Example 10

A coating liquid P for forming an undercoat layer was prepared as in Example 2 except that the dispersion apparatus used was an Ultra Apex Mill (model UAM-1, manufactured by Kotobuki Industries Co., Ltd.) having a mill capacity of about 1 L instead of the Ultra Apex Mill (model UAM-015, manufactured by Kotobuki Industries Co., Ltd.) used in Example 2, and the flow rate of the coating liquid for forming an undercoat layer was 30 kg/hour. The physical properties were measured as in Example 1. The results are shown in Table 2.

Example 11

A coating liquid Q for forming an undercoat layer was prepared as in Example 2 except that the dispersion apparatus used was an Ultra Apex Mill (model UAM-1, manufactured by Kotobuki Industries Co., Ltd.) having a mill capacity of about 1 L instead of the Ultra Apex Mill (model UAM-015, manufactured by Kotobuki Industries Co., Ltd.) used in Example 2, zirconia beads with a diameter of about 30 μm (YTZ, manufactured by Nikkato Corp.) were used as a dispersion medium, the peripheral velocity of the rotor was 12 m/second, and the flow rate of the coating liquid for forming an undercoat layer was 30 kg/hour. The physical properties were measured as in Example 1. The results are shown in Table 2.

Comparative Example 7

A coating liquid R for forming an undercoat layer was prepared as in Comparative Example 1 except that Aluminium Oxide C (aluminium oxide particles) having an average primary particle diameter of 13 nm (manufactured by Nippon Aerosil Co., Ltd.) was used instead of the surface-treated titanium oxide used in Comparative Example 1, the solid content contained was 8.0 wt %, the weight ratio of aluminum oxide particle/copolymerized polyamide was 1/1, and the dispersion treatment was conducted with an ultrasonic oscillator at an output of 600 W for 6 hours instead of the ball mill. The physical properties were measured. The results are shown in Table 2.

Furthermore, the difference between absorbance to light with 400 nm wavelength and the absorbance to light with 1000 nm wavelength was measured as in Example 2 except that the solid content was 0.015 wt % (metal oxide particle concentration: 0.0075 wt %). The results are shown in Table 3.

[Evaluation of Regular Reflection Rate]

The regular reflection rate of each of the undercoat layers formed on electroconductive supports with the coating liquids for forming an undercoat layer prepared in Examples 2, 5 to 7 and Comparative Examples 1, 3, 4, and 7 were evaluated as follows. The results are shown in Table 4.

Undercoat layers with a dried thickness of 2 μm were each formed by applying the coating liquid for forming an undercoat layer shown in Table 4 to an aluminum tube (an extruded mirror surface tube or a cut tube) having an outer diameter of 30 mm, a length of 250 mm, and a thickness of 0.8 mm and drying the liquid.

The reflectance of the undercoat layer to light of 400 nm wavelength or light of 480 nm wavelength was measured with a multispectrophotometer (MCPD-3000, manufactured by Otsuka Electronics Co., Ltd.). A halogen lamp was used as a light source, and the light source and the tip of a fiber-optic cable mounted on a detector were arranged at a position apart from the surface of the undercoat layer by 2 mm in the vertical direction. The surface of the undercoat layer was irradiated with light from the direction perpendicular to the surface, and reflected light in the opposite direction on the same axis was detected. The light reflected from the surface of a cut aluminum tube without the undercoat layer was measured, and this reflectance was defined as 100%. The light reflected from the surface of the undercoat layer was measured, and the ratio of this value to the above value was defined as regular reflection rate (%). The results are shown in Table 4.

TABLE 2

Physical properties of coating liquid for forming an undercoat layer

| | Coating liquid | Medium | Medium diameter | Rotor peripheral velocity | Rate of change in viscosity | D50 (μm) | D16 (μm) | D84 (μm) | SD |
|---|---|---|---|---|---|---|---|---|---|
| Example 1 | A | zirconia | 100 μm | 10 m/s | 6% increase | 0.0917 | 0.0541 | 0.1122 | 0.029 |
| Example 2 | B | zirconia | 50 μm | 10 m/s | 2% increase | 0.0856 | 0.0526 | 0.1088 | 0.028 |
| Example 3 | C | zirconia | 50 μm | 12 m/s | 4% increase | 0.0812 | 0.0532 | 0.1024 | 0.025 |
| Example 4 | D | zirconia | 30 μm | 12 m/s | 2% increase | 0.0759 | 0.0552 | 0.1011 | 0.023 |
| Example 7 | G | zirconia | 50 μm | 10 m/s | — | 0.0850 | 0.0524 | 0.1104 | 0.029 |
| Example 8 | H | zirconia | 50 μm | 10 m/s | — | 0.0667 | 0.0434 | 0.0957 | 0.026 |
| Example 9 | I | zirconia | 50 μm | 10 m/s | — | 0.0687 | 0.0510 | 0.0912 | 0.020 |
| Example 10 | P | zirconia | 50 μm | 10 m/s | — | 0.0740 | 0.0492 | 0.1095 | 0.030 |
| Example 11 | Q | zirconia | 30 μm | 12 m/s | — | 0.0722 | 0.0487 | 0.1046 | 0.028 |
| Comparative Example 1 | J | alumina | 5 mm | — | 38.5% increase | 0.1331 | 0.0762 | 0.1577 | 0.041 |
| Comparative Example 2 | K | zirconia | 5 mm | — | — | 1.2543 | 0.0841 | 1.9840 | 0.950 |
| Comparative Example 7 | R | alumina | 5 mm | — | — | 0.1773 | 0.0666 | 0.1644 | 0.049 |

—: Not applicable or not measured
SD = (D84 − D16)/2

TABLE 3

Absorbance of coating liquid for forming an undercoat layer

| | Coating liquid | Metal oxide particle/ copolymerized polyamide (weight ratio) | Metal oxide particle content (wt %) | Absorbance difference (Abs) |
|---|---|---|---|---|
| Example 2 | B | 3/1 | 0.011 | 0.688 |
| Example 5 | E | 2/1 | 0.01 | 0.980 |
| Example 6 | F | 4/1 | 0.012 | 0.919 |
| Example 7 | G | 1/1 | 0.0075 | 0.014 |
| Comparative Example 1 | J | 3/1 | 0.011 | 1.649 |
| Comparative Example 3 | L | 2/1 | 0.01 | 1.076 |
| Comparative Example 4 | M | 4/1 | 0.012 | 1.957 |
| Comparative Example 7 | R | 1/1 | 0.0075 | 0.056 |

TABLE 4

Regular reflection rate (%) of undercoat layer

| | Coating liquid | Wavelength for measurement | Extruded mirror surface tube | Cut tube (cut pitch: 0.6 mm) | Cut tube (cut pitch: 0.95 mm) |
|---|---|---|---|---|---|
| Example 2 | B | 480 nm | 57.4 | 57.3 | 57.8 |
| Example 5 | E | 480 nm | 56.4 | 56.4 | 54.9 |
| Example 6 | F | 480 nm | 57.6 | 56.5 | 58.6 |
| Example 7 | G | 400 nm | 64.6 | 65.4 | 57.2 |
| Comparative Example 1 | J | 480 nm | 40.2 | 39.8 | 41.8 |
| Comparative Example 3 | L | 480 nm | 35.8 | 37.1 | 37.5 |
| Comparative Example 4 | M | 480 nm | 26.2 | 25.0 | 27.5 |
| Comparative Example 7 | R | 400 nm | 48.3 | 49.0 | 39.6 |

The above results confirmed that the coating liquids for forming an undercoat layer prepared by the process of the present invention have small average particle diameters and narrow particle size distribution widths, and consequently have high stability and are capable of forming a uniform undercoat layer. In addition, viscosity is not significantly increased even when stored for a long period of time, thus showing high stability. Furthermore, the undercoat layers formed with the coating liquids for forming an undercoat layer have high uniformity not to highly scatter light, thus exhibiting high regular reflection rates.

Example 12

The coating liquid A for forming an undercoat layer was applied to a cut aluminum tube having an outer diameter of 24 mm, a length of 236.5 mm, and a thickness of 0.75 mm by dipping to form an undercoat layer with a dried thickness of 2 μm. The surface of the undercoat layer was observed by a scanning electron microscope to confirm substantially no agglomeration.

Figure 2:
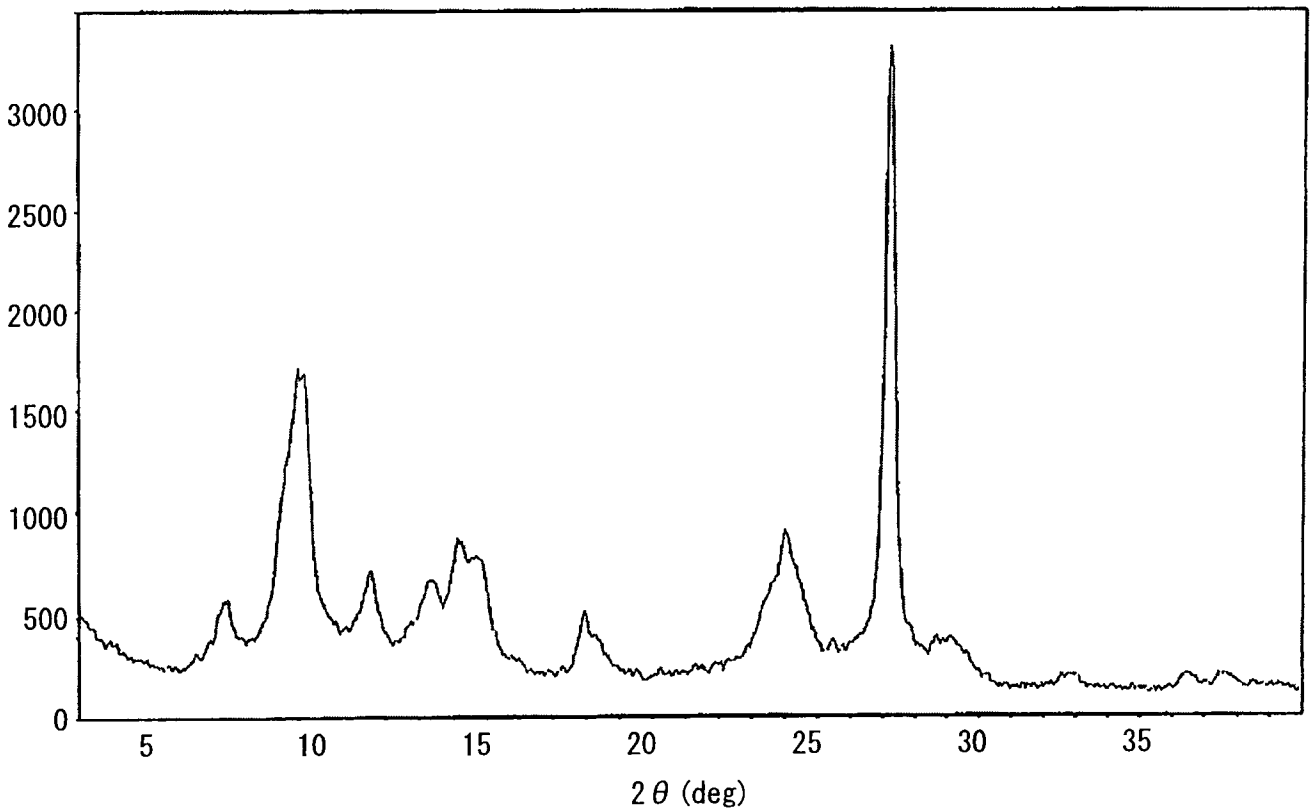
FIG. 2 is a powder X-ray diffraction spectrum pattern of oxytitanium phthalocyanine used as a charge-generating material in the electrophotographic photoreceptor of Example 12, to CuKα characteristic X-rays.

A dispersion was prepared by mixing 20 parts by weight of oxytitanium phthalocyanine, as a charge-generating material, having a powder X-ray diffraction spectrum pattern to CuKα characteristic X-rays shown in FIG. 2 and 280 parts by weight of 1,2-dimethoxyethane and subjecting the mixture to dispersion treatment in a sand grind mill for 2 hours. Then, this dispersion was mixed with 10 parts by weight of polyvinyl butyral (trade name "Denka Butyral" #6000C, manufactured by Denki Kagaku Kogyo K. K.), 253 parts by weight of 1,2-dimethoxyethane, and 85 parts by weight of 4-methoxy-4-methylpentanone-2. The mixture was further mixed with 234 parts by weight of 1,2-dimethoxyethane, and the resulting mixture was treated with an ultrasonic dispersing device and then filtered through a PTFE membrane filter with a pore size of 5 μm (Mitex LC, manufactured by Advantech Co., Ltd.) to give a coating liquid for forming a charge-generating layer. This coating liquid for forming a charge-generating layer was applied onto the undercoat layer by dipping and dried to form a charge-generating layer having a dried thickness of 0.4 μm.

Then, on this charge-generating layer was applied a coating liquid for forming a charge-transporting layer prepared by dissolving 56 parts of a hydrazone compound shown below:

[Chemical Formula 5]

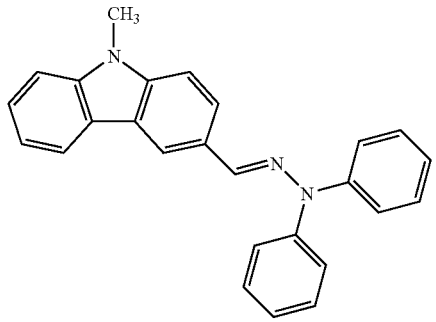

14 parts of a hydrazone compound shown below:

[Chemical Formula 6]

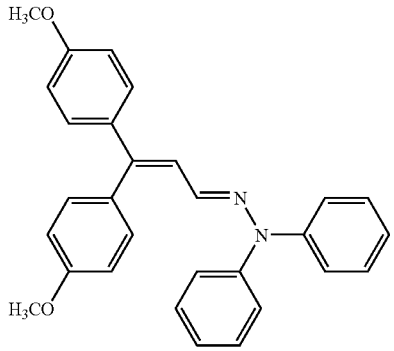

100 parts of a polycarbonate resin having a repeating structure shown below:

[Chemical Formula 7]

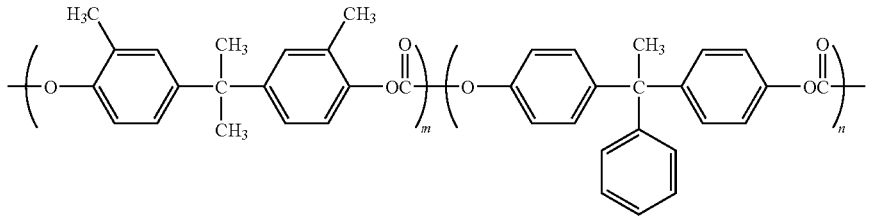

(m:n = 1:1)

and 0.05 part by weight of a silicone oil in 640 parts by weight of a solvent mixture of tetrahydrofuran/toluene=8/2 (weight ratio). By the air-drying at room temperature for 25 minutes, a layer with a thickness of 17 μm was given.

The layer was further dried at 125° C. for 20 minutes to form an electrophotographic photoreceptor having a charge-transporting layer. The thus prepared electrophotographic photoreceptor was used as photoreceptor P1.

The dielectric breakdown strength of the photoreceptor P1 was measured as follows: The photoreceptor was fixed at a temperature of 25° C. and a relative humidity of 50%, and a charging roller having a volume resistivity of about 2 MΩ·cm and having a length about 2 cm shorter than that of the drum at both ends was pressed on the photoreceptor for applying a direct-current voltage of −3 kV, and the time until dielectric breakdown was measured. The results are shown in Table 5.

The photoreceptor P1 was mounted on an electrophotographic characteristic evaluation device produced in accordance with a standard of The Society of Electrophotography of Japan (Zoku Denshi Shashin Gijutsu no Kiso to Oyo (Fundamentals and Applications of Electrophotography II) edited by The Society of Electrophotography of Japan, published by Corona Publishing Co., Ltd., pp. 404-405) and was charged such that the surface potential was −700 V and then was irradiated with a 780 nm laser at an intensity of 5.0 μJ/cm$^2$. The surface potential VL at 100 ms after the exposure was measured at 25° C. and a relative humidity of 50% (hereinafter, optionally, referred to as NN circumstances) and at 5° C. and a relative humidity of 10% (hereinafter, optionally, referred to as LL circumstances). The results are shown in Table 5.

Example 13

A photoreceptor P2 was produced as in Example 12 except that the thickness of the undercoat layer was 3 μm. The surface of the undercoat layer was observed with a scanning electron microscope as in Example 12 to confirm substantially no agglomeration.

The photoreceptor P2 was evaluated as in Example 12. The results are shown in Table 5.

Example 14

A coating liquid A2 for forming an undercoat layer was prepared as in Example 1 except that the weight ratio of titanium oxide and a copolymerized polyamide (titanium oxide/copolymerized polyamide) was 2/1.

A photoreceptor P3 was produced as in Example 12 except that the coating liquid A2 was used as a coating liquid for forming an undercoat layer. The surface of the undercoat layer was observed with a scanning electron microscope as in Example 12 to confirm substantially no agglomeration.

The photoreceptor P3 was evaluated as in Example 12. The results are shown in Table 5.

Example 15

A photoreceptor Q1 was produced as in Example 12 except that the coating liquid B for forming an undercoat layer described in Example 2 was used as a coating liquid for forming an undercoat layer. The surface of the undercoat layer was observed with a scanning electron microscope as in Example 12 to confirm substantially no agglomeration.

The surface state of the undercoat layer was measured with Micromap manufactured by Ryoka Systems Inc. in a Wave mode, at a measurement wavelength of 552 nm, at a magnification of objective lens of 40 times, with a measurement area of 190 μm by 148 μm, and with background shape correction (Term) of cylinder. The in-plane root mean square roughness (RMS) was 43.2 nm, the in-plane arithmetic mean roughness (Ra) was 30.7 nm, and the in-plane maximum roughness (P-V) was 744 nm.

The photoreceptor Q1 was evaluated as in Example 12. The results are shown in Table 5.

The surface potential decay rate (DDR) when the initial surface potential (−700 V) was retained for 5 seconds in a dark place under NN circumstances was measured. The DDR represents the rate of a surface potential after the retention for 5 seconds to the initial surface potential and is expressed by %. The results are shown in Table 6.

Example 16

A photoreceptor Q2 was produced as in Example 15 except that the thickness of the undercoat layer was 3 μm. The surface of the undercoat layer was observed with a scanning electron microscope as in Example 12 to confirm substantially no agglomeration.

The photoreceptor Q2 was evaluated as in Example 12. The results are shown in Table 5.

Example 17

A photoreceptor Q3 was produced as in Example 15 except that the coating liquid E was used as a coating liquid for forming an undercoat layer. The surface of the undercoat layer was observed with a scanning electron microscope as in Example 12 to confirm substantially no agglomeration.

The photoreceptor Q3 was evaluated as in Example 12. The results are shown in Table 5.

Example 18

A photoreceptor R1 was produced as in Example 12 except that the coating liquid C for forming an undercoat layer described in Example 3 was used as a coating liquid for forming an undercoat layer. The surface of the undercoat layer was observed with a scanning electron microscope as in Example 12 to confirm substantially no agglomeration.

The photoreceptor R1 was evaluated as in Example 12. The results are shown in Table 5.

Example 19

A photoreceptor R2 was produced as in Example 18 except that the thickness of the undercoat layer was 3 μm. The surface of the undercoat layer was observed with a scanning electron microscope as in Example 12 to confirm substantially no agglomeration.

The photoreceptor R2 was evaluated as in Example 12. The results are shown in Table 5.

Example 20

A coating liquid C2 for forming an undercoat layer was prepared as in Example 3 except that the weight ratio of titanium oxide and a copolymerized polyamide (titanium oxide/copolymerized polyamide) was 2/1.

A photoreceptor R3 was produced as in Example 18 except that the coating liquid C2 was used as a coating liquid for forming an undercoat layer. The surface of the undercoat layer was observed with a scanning electron microscope as in Example 12 to confirm substantially no agglomeration.

The photoreceptor R3 was evaluated as in Example 12. The results are shown in Table 5.

Example 21

A photoreceptor S1 was produced as in Example 12 except that the coating liquid D for forming an undercoat layer described in Example 4 was used as a coating liquid for forming an undercoat layer. The surface of the undercoat layer was observed with a scanning electron microscope as in Example 12 to confirm substantially no agglomeration.

The surface state of the undercoat layer was measured as in Example 12. The in-plane root mean square roughness (RMS) was 25.5 nm, the in-plane arithmetic mean roughness (Ra) was 17.7 nm, and the in-plane maximum roughness (P-V) was 510 nm.

The photoreceptor S1 was evaluated as in Example 12. The results are shown in Table 5.

Example 22

A photoreceptor S2 was produced as in Example 21 except that the thickness of the undercoat layer was 3 μm. The surface of the undercoat layer was observed with a scanning electron microscope as in Example 12 to confirm substantially no agglomeration.

The photoreceptor S2 was evaluated as in Example 12. The results are shown in Table 5.

Example 23

A coating liquid D2 for forming an undercoat layer was prepared as in Example 4 except that the weight ratio of titanium oxide and a copolymerized polyamide (titanium oxide/copolymerized polyamide) was 2/1.

A photoreceptor S3 was produced as in Example 21 except that the coating liquid D2 was used as a coating liquid for forming an undercoat layer. The surface of the undercoat layer was observed with a scanning electron microscope as in Example 12 to confirm substantially no agglomeration.

The photoreceptor S3 was evaluated as in Example 12. The results are shown in Table 5.

Example 24

A photoreceptor QA1 was produced as in Example 12 except that the coating liquid F for forming an undercoat layer described in Example 6 was used as a coating liquid for forming an undercoat layer.

Example 25

A photoreceptor QB1 was produced as in Example 12 except that the coating liquid H for forming an undercoat layer described in Example 8 was used as a coating liquid for forming an undercoat layer.

Example 26

A photoreceptor QC1 was produced as in Example 12 except that the coating liquid I for forming an undercoat layer described in Example 9 was used as a coating liquid for forming an undercoat layer.

Comparative Example 8

A photoreceptor T1 was produced as in Example 12 except that the coating liquid J for forming an undercoat layer described in Comparative Example 1 was used as a coating liquid for forming an undercoat layer. The surface of the undercoat layer was observed with a scanning electron microscope as in Example 12 to confirm a large number of titanium oxide agglomerations.

The surface state of the undercoat layer was measured as in Example 15. The in-plane root mean square roughness (RMS) was 148.4 nm, the in-plane arithmetic mean roughness (Ra) was 95.3 nm, and the in-plane maximum roughness (P-V) was 2565 nm.

The photoreceptor T1 was evaluated as in Example 12. The results are shown in Table 5.

Comparative Example 9

A photoreceptor T2 was produced as in Comparative Example 8 except that the thickness of the undercoat layer was 3 μm. The surface of the undercoat layer was observed with a scanning electron microscope as in Example 12 to confirm a large number of titanium oxide agglomerations.

The photoreceptor T2 was evaluated as in Example 12. The results are shown in Table 5.

Comparative Example 10

A photoreceptor T3 was produced as in Comparative Example 8 except that the coating liquid L was used as a coating liquid for forming an undercoat layer. The surface of the undercoat layer was observed with a scanning electron microscope as in Example 12 to confirm a large number of titanium oxide agglomerations.

The photoreceptor T3 was evaluated as in Example 12. The results are shown in Table 5.

Comparative Example 11

A photoreceptor U1 was produced as in Example 12 except that the coating liquid K for forming an undercoat layer described in Comparative Example 2 was used as a coating liquid for forming an undercoat layer. The surface of the undercoat layer was observed with a scanning electron microscope as in Example 12 to confirm a large number of titanium oxide agglomerations.

In the undercoat layer of the photoreceptor U1, the components were inhomogeneous and the thickness was uneven. Consequently, the electric characteristics were not evaluated.

Comparative Example 12

A photoreceptor TA1 was produced as in Example 12 except that the coating liquid M for forming an undercoat layer described in Comparative Example 4 was used as a coating liquid for forming an undercoat layer.

Comparative Example 13

A photoreceptor TB1 was produced as in Example 12 except that the coating liquid N for forming an undercoat layer described in Comparative Example 5 was used as a coating liquid for forming an undercoat layer.

Comparative Example 14

A photoreceptor TC1 was produced as in Example 12 except that the coating liquid O for forming an undercoat layer described in Comparative Example 6 was used as a coating liquid for forming an undercoat layer.

TABLE 5

Electric characteristics of photoreceptor and time until dielectric breakdown

| | Photoreceptor | Titanium oxide/copolymerized polyamide (weight ratio) | Undercoat layer thickness | VL (NN) | VL (LL) | Time until dielectric breakdown |
|---|---|---|---|---|---|---|
| Example 12 | P1 | 3/1 | 2 μm | −76 V | −173 V | 19.4 min |
| Example 13 | P2 | 3/1 | 3 μm | — | — | — |
| Example 14 | P3 | 2/1 | 2 μm | −98 V | −221 V | 21.8 min |
| Example 15 | Q1 | 3/1 | 2 μm | −77 V | −174 V | 18.5 min |
| Example 16 | Q2 | 3/1 | 3 μm | −82 V | −195 V | — |
| Example 17 | Q3 | 2/1 | 2 μm | −98 V | −223 V | 21.4 min |
| Example 18 | R1 | 3/1 | 2 μm | −77 V | −161 V | 16.1 min |
| Example 19 | R2 | 3/1 | 3 μm | −81 V | −176 V | — |
| Example 20 | R3 | 2/1 | 2 μm | −102 V | −218 V | 20.2 min |
| Example 21 | S1 | 3/1 | 2 μm | −83 V | −176 V | 13.6 min |
| Example 22 | S2 | 3/1 | 3 μm | −87 V | −191 V | — |
| Example 23 | S3 | 2/1 | 2 μm | −109 V | −232 V | 21.4 min |
| Comparative Example 8 | T1 | 3/1 | 2 μm | −76 V | −151 V | 2.8 min |
| Comparative Example 9 | T2 | 3/1 | 3 μm | −82 V | −175 V | — |
| Comparative Example 10 | T3 | 2/1 | 2 μm | −103 V | −215 V | 14.6 min |
| Comparative Example 11 | U1 | 3/1 | 2 μm | — | — | — |

Table 6 shows the measurement results of DDR of Examples 24 to 26 and Comparative Examples 8 and 12 to 14, which were measured as in Example 15.

TABLE 6

Measurement result of DDR

| | Photo-receptor | Titanium oxide/ copolymerized polyamide (weight ratio) | Coating liquid for forming an undercoat layer | DDR (%) |
|---|---|---|---|---|
| Example 15 | Q1 | 3/1 | B | 95 |
| Example 24 | QA1 | 4/1 | F | 95 |
| Example 25 | QB1 | 6/1 | H | 93 |
| Example 26 | QC1 | 8/1 | I | 91 |
| Comparative Example 8 | T1 | 3/1 | J | 93 |
| Comparative Example 12 | TA1 | 4/1 | M | 91 |
| Comparative Example 13 | TB1 | 6/1 | N | 88 |
| Comparative Example 14 | TC1 | 8/1 | O | 85 |

The above results elucidate that the electrophotographic photoreceptors of the present invention had homogeneous undercoat layers without agglomeration and exhibited low potential variation due to environmental variation and high resistance to dielectric breakdown and that dark decay was small. These phenomena became more significant as the proportion of the metal oxide microparticles increases.

Example 27

The coating liquid B for forming an undercoat layer, which was prepared in Example 2, was applied to a cut aluminum tube with an outer diameter of 30 mm, a length of 285 mm, and a thickness of 0.8 mm by dipping to form an undercoat layer with a dried thickness of 2.4 μm. The surface of the undercoat layer was observed with a scanning electron microscope to confirm substantially no agglomeration.

This undercoat layer (94.2 $cm^2$) was immersed in a solvent mixture of 70 $cm^3$ of methanol and 30 $cm^3$ of 1-propanol and was sonicated with an ultrasonic oscillator at an output of 600 W for 5 minutes to prepare an undercoat layer dispersion. The particle size distribution of the metal oxide particles in the dispersion was measured with the UPA as in Example 1. The cumulative volume average diameter D50 was 0.0776 μm, and the volume particle size distribution width index SD was 0.029.

A coating liquid for forming a charge-generating layer was prepared as in Example 12 and was applied onto the undercoat layer by dipping to form a charge-generating layer having a dried thickness of 0.4 μm.

Then, on this charge-generating layer was applied a coating liquid containing 60 parts of a composition (A) described in Japanese Unexamined Patent Application Publication No. 2002-080432 as a charge-transporting material having the following main structure:

[Chemical Formula 8]

composition (A)

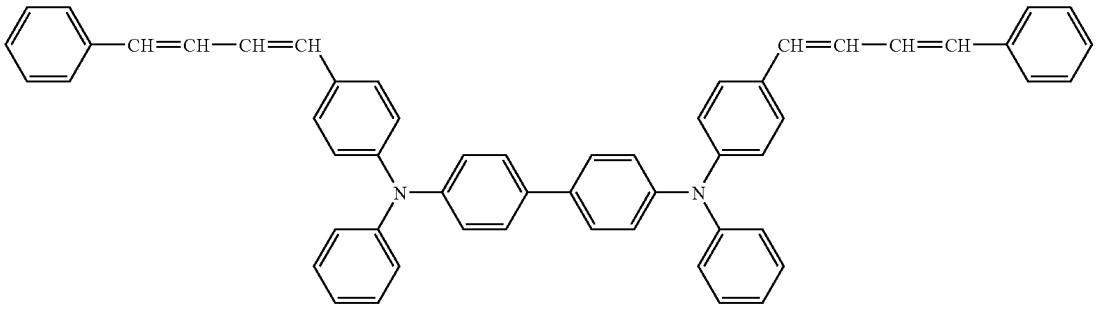

100 parts of a polycarbonate resin having a repeating structure shown below:

[Chemical Formula 9]

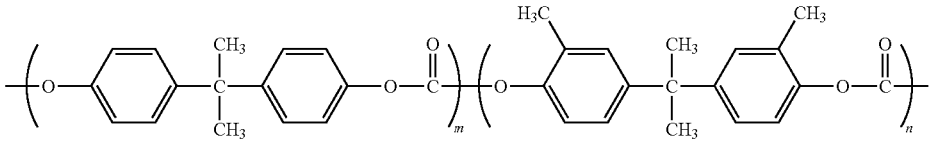

(m:n = 7:3)

and 0.05 part by weight of a silicone oil in 640 parts by weight of a solvent mixture of tetrahydrofuran/toluene (8/2) to give a charge-transporting layer with a dried thickness of 10 μm. The layer was further dried to form an electrophotographic photoreceptor having the charge-transporting layer.

The photosensitive layer (94.2 $cm^2$) of the resulting electrophotographic photoreceptor was removed by dissolving the layer in 100 $cm^3$ of tetrahydrofuran by sonication with an ultrasonic oscillator at an output of 600 W for 5 minutes, and then the electrophotographic photoreceptor after the sonication treatment was immersed in a solvent mixture of 70 $cm^3$ of methanol and 30 $cm^3$ of 1-propanol and was sonicated with an ultrasonic oscillator at an output of 600 W for 5 minutes to give an undercoat layer dispersion. The particle size distribution of the metal oxide particles in the dispersion was measured with the UPA as in Example 1. The cumulative volume average diameter D50 was 0.0791 μm, and the volume particle size distribution width index SD was 0.029.

The produced photoreceptor was mounted on a cartridge (having a scorotron charging member and a blade cleaning member as an imaging unit cartridge) of a color printer (product name: InterColor LP-1500C, manufactured by Seiko Epson Corp., resolution: 600 dpi) to form a full-color image. The printed image was excellent. The number of small color spots observed in 1.6 cm square in the image is shown in Table 7.

The coating liquid for forming an undercoat layer was stored for 3 months, and a full-color image was formed similarly. The number of small color spots observed in 1.6 cm square in the image is shown in Table 7 as image defects after 3 months.

Example 28

A full-color image was formed as in Example 27 except that the coating liquid C for forming an undercoat layer described in Example 3 was used as a coating liquid for forming an undercoat layer. The image was excellent. The number of small color spots observed in 1.6 cm square in the image is shown in Table 7.

A full-color image was formed after 3 months as in Example 27, and image defects were counted. The results are shown in Table 7.

Example 29

A full-color image was formed as in Example 27 except that the coating liquid D for forming an undercoat layer described in Example 4 was used as a coating liquid for forming an undercoat layer. The printed image was excellent. The number of small color spots observed in 1.6 cm square in the image is shown in Table 7.

A full-color image was formed after 3 months as in Example 27, and image defects were counted. The results are shown in Table 7.

Comparative Example 15

An electrophotographic photoreceptor was produced as in Example 27 except that the coating liquid J for forming an undercoat layer described in Comparative Example 1 was used as a coating liquid for forming an undercoat layer.

The undercoat layer (94.2 $cm^2$) of the electrophotographic photoreceptor was immersed in a solvent mixture of 70 $cm^3$ of methanol and 30 $cm^3$ of 1-propanol and was sonicated with an ultrasonic oscillator at an output of 600 W for 5 minutes to prepare an undercoat layer dispersion. The particle size distribution of the agglomerated metal oxide particles (secondary particles) in the dispersion was measured as in Example 1. The cumulative volume average diameter D50 was 0.1097 μm, and the volume particle size distribution width index SD was 0.042.

The photosensitive layer (94.2 $cm^2$) of the resulting electrophotographic photoreceptor was removed by dissolving the layer in 100 $cm^3$ of tetrahydrofuran by sonication with an ultrasonic oscillator at an output of 600 W for 5 minutes, and then the electrophotographic photoreceptor after the sonication treatment was immersed in a solvent mixture of 70 $cm^3$ of methanol and 30 $cm^3$ of 1-propanol and was sonicated with an ultrasonic oscillator at an output of 600 W for 5 minutes to give an undercoat layer dispersion. The particle size distribution of the metal oxide particles in the dispersion was measured with the same method as in Example 1. The cumulative volume average diameter D50 was 0.1155 μm, and the volume particle size distribution width index SD was 0.043.

A full-color image was formed using this electrophotographic photoreceptor. A large number of color spots were observed, and satisfactory image was not formed. The number of small color spots observed in 1.6 cm square in the image is shown in Table 7.

A full-color image was formed after 3 months as in Example 27, and image defects were counted. The results are shown in Table 7.

TABLE 7

Image evaluation by image-forming apparatus

| | Medium | Diameter of medium | Peripheral velocity of rotor | Titanium oxide/copolymerized polyamide (weight ratio) | Thickness of undercoat layer | Number of Image defect (small color spot) | Number of Image defect after 3 months (small color spot) |
|---|---|---|---|---|---|---|---|
| Example 27 | zirconia | 50 μm | 10 m/s | 3/1 | 2.4 μm | 11 | 9 |
| Example 28 | zirconia | 50 μm | 12 m/s | 3/1 | 2.4 μm | 8 | 10 |
| Example 29 | zirconia | 30 μm | 12 m/s | 3/1 | 2.4 μm | 10 | 7 |
| Comparative Example 15 | alumina | 5 mm | — | 3/1 | 2.4 μm | 30 | 110 |

In order to investigate the water-absorbing property of the coating liquid for forming an undercoat layer, the same amounts of the coating liquid B of Example 2 and the coating liquid J of Comparative Example 1 were each fed in a dip coating bath and were circulated while being allowed to overflow from the open top of the coating bath under a circumstance of 30% RH and about 23° C. The moisture content of each liquid collected from the top of the bath was measured by Karl Fischer method over time. The results are shown in Table 8.

TABLE 8

| Time-lapse moisture content in coating liquid for forming an undercoat layer | | |
|---|---|---|
| Lapse time | Moisture content % in coating liquid B | Moisture content % in coating liquid J |
| Beginning of the charging | 0.6 | 0.6 |
| After 1 month | 0.6 | 0.7 |
| After 2 months | 0.6 | 2.0 |
| After 3 months | 0.7 | 2.3 |
| After 4 months | 1.1 | 2.6 |
| After 5 months | 1.1 | 2.6 |
| After 6 months | 1.5 | 2.4 |

The results elucidate that the electrophotographic photoreceptors of the present invention had excellent photoreceptive characteristics and high resistance to dielectric breakdown and also had significantly excellent performances, i.e., reduced image defects such as color spots. In addition, in the stability of the liquid, the absorption of water was low over time. In particular, the differences when compared to the comparative example were significantly large after 2 months or later. Thus, the coating liquid for forming an undercoat layer of the present invention exhibits stable application characteristics over a long period of time without degradation of coating characteristics or occurrence of image defects.

Example 30

The photoreceptor Q1 produced in Example 15 was fixed at 25° C. and a humidity of 50%, and a charging roller having a volume resistivity of about 2 MΩ·cm and having a length about 2 cm shorter than that of the drum at both ends was pressed on the photoreceptor Q1, and a direct-current voltage of −1 kV was applied to the photoreceptor Q1 for 1 minute and then a direct-current voltage of −1.5 kV for 1 minute. The voltage applied was decreased by −0.5 kV every 1 minute. Dielectric breakdown occurred at an applied direct-current voltage of −4.5 kV.

Example 31

A photoreceptor was produced as in Example 15 except that the coating liquid D for forming an undercoat layer was used instead of the coating liquid B for forming an undercoat layer used in Example 15. A variable direct-current voltage was applied to the photoreceptor as in Example 30. Dielectric breakdown occurred at an applied direct-current voltage of −4.5 kV.

Comparative Example 16

A variable direct-current voltage was applied to the photoreceptor T1 produced in Comparative Example 6 which was used instead of the photoreceptor Q1 produced in Example 15, as in Example 30. Dielectric breakdown occurred at an applied direct-current voltage of −3.5 kV.

Example 32

The photoreceptor Q1 produced in Example 15 was mounted on a printer ML1430 (including an integrated cartridge consisting of a contact-type charging roller member and a monochrome development member) manufactured by Samsung Co., Ltd., and image formation was repeated at a printing concentration of 5% for observing image defects due to dielectric breakdown. No image defect was observed in 50000 images formed.

Comparative Example 17

The photoreceptor T1 produced in Comparative Example 8 was mounted on a printer ML1430 manufactured by Samsung Co., Ltd. Image formation was repeated at a printing concentration of 5% for observing image defects caused by dielectric breakdown, and image defect was observed when 35000 images were formed.

Example 33

The coating liquid B for forming an undercoat layer was applied to a cut aluminum tube having an outer diameter of 24 mm, a length of 236.5 mm, and a thickness of 0.75 mm by dipping to form an undercoat layer with a dried thickness of 2 μm.

After mixing 1.5 parts of a charge-generating material represented by the following Formula:

[Chemical Formula 10]

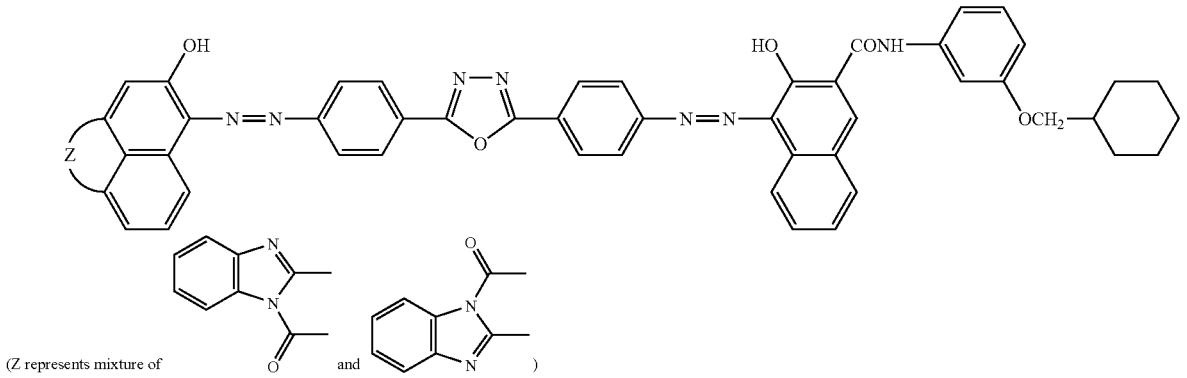

and 30 parts of 1,2-dimethoxyethane, the mixture was pulverized in a sand grind mill for 8 hours for microparticle dispersion treatment. Then, the mixture was mixed with a binder liquid prepared by dissolving 0.75 part of polyvinyl butyral (trade name "Denka Butyral" #6000C, manufactured by Denki Kagaku Kogyo K. K.) and 0.75 part of a phenoxy resin (PKHH, a product of Union Carbide Corp.) in 28.5 parts of 1,2-dimethoxyethane. Finally, 13.5 parts of an arbitrary liquid mixture of 1,2-dimethoxyethane and 4-methoxy-4-methyl-2-pentanone was added to the mixture to prepare a coating liquid for forming a charge-generating layer containing 4.0 wt % solid components (pigment and resin). This coating liquid for forming a charge-generating layer was applied onto the undercoat layer by dipping and drying it to form a charge-generating layer having a dried thickness of 0.6 μm.

Then, on this charge-generating layer applied was a coating liquid for forming a charge-transporting layer prepared by dissolving 67 parts of a triphenylamine compound shown below:

[Chemical Formula 11]

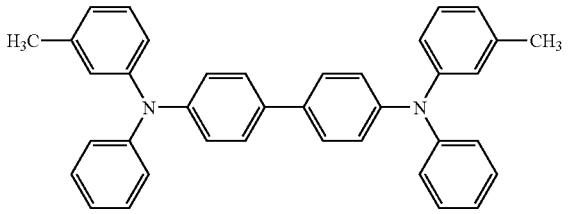

100 parts of a polycarbonate resin having a repeating structure shown below:

[Chemical Formula 12]

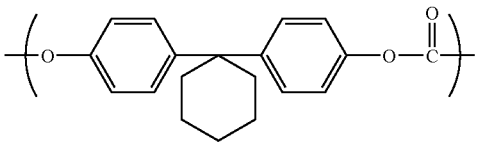

0.5 part of a compound having the following structure:

[Chemical Formula 13]

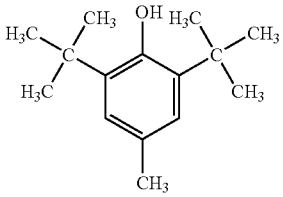

and 0.02 part by weight of a silicone oil in 640 parts by weight of a solvent mixture of tetrahydrofuran/toluene (8/2). The applied liquid was air-dried at room temperature for 25 minutes to give a charge-transporting layer with a dried thickness of 25 μm. The layer was further dried at 125° C. for 20 minutes to form an electrophotographic photoreceptor having the charge-transporting layer.

The resulting electrophotographic photoreceptor was mounted on an electrophotographic characteristic evaluation device produced in accordance with a standard of The Society of Electrophotography of Japan (Zoku Denshi Shashin Gizyutsu no Kiso to Oyo (Fundamentals and Applications of Electrophotography II) edited by The Society of Electrophotography of Japan, published by Corona Publishing Co., Ltd., pp. 404-405), and electric characteristics thereof were evaluated by the cycle of charging, exposure, potential measurement, and charge elimination, according to the following procedure.

The initial surface potential of the photoreceptor that was charged by discharging with a scorotron charging device at a grid voltage of −800 V in a dark place was measured. Then, the photoreceptor was irradiated with monochromatic light of 450 nm emitted from a halogen lamp and monochromatized through an interference filter. The irradiation energy (μJ/cm$^2$) required for the surface potential to reach −350 V was measured as sensitivity $E_{1/2}$. The initial charging potential was −708 V, and the sensitivity $E_{1/2}$ was 3.288 μJ/cm$^2$. A larger value of the initial charging potential (a larger absolute value of the potential) represents a better charging property, and a lower value of the sensitivity represents a higher sensitivity.

Comparative Example 18

An electrophotographic photoreceptor was produced as in Example 33 except that the coating liquid J for forming an undercoat layer described in Comparative Example 1 was used as a coating liquid for forming an undercoat layer. The electric characteristics of this electrophotographic photoreceptor were evaluated as in Example 33. The initial charging potential was −696 V and the sensitivity $E_{1/2}$ was 3.304 μJ/cm$^2$.

The results in Example 33 and Comparative Example 18 elucidate that the electrophotographic photoreceptor of the present invention had high sensitivity to exposure to monochromatic light having a wavelength of 350 nm to 600 nm.

Industrial Applicability

The present invention can be applied to any industrial field, in particular, can be preferably applied to, for example, printers, facsimile machines, and copiers of electrophotographic systems.

Although the present invention has been described in detail with reference to certain preferred embodiments, those skilled in the art will recognize that various modifications will be made without departing from the purpose and scope of the present invention.

The present application is based on Japanese Patent Application (Patent Application No. 2006-139531) filed on May 18, 2006, the entire contents of which are hereby incorporated by reference.

The invention claimed is:

1. A coating liquid for forming an undercoat layer of an electrophotographic photoreceptor containing metal oxide particles and a binder resin, wherein the metal oxide particles have a cumulative volume average diameter D50 of 0.1 μm or less and a volume particle size distribution width index SD satisfying the following Expression (1) which are measured by a dynamic light-scattering method in the coating liquid for forming an undercoat layer, $$0.010 \leq SD \leq 0.040 \quad (1)$$

wherein SD=(D84−D16)/2, wherein D84 represents the particle diameter (μm) at a point of 84% in the cumulative volume particle size distribution curve, and D16 represents the particle diameter (μm) at a point of 16% in the cumulative volume particle size distribution curve; and particle size distribution is accumulated from the smaller particle size side.

2. The coating liquid for forming an undercoat layer of an electrophotographic photoreceptor according to claim 1, wherein the SD satisfies the following Expression (2):

$$0.020 \leqq SD \leqq 0.030 \quad (2).$$

3. A method for preparing a coating liquid for forming an undercoat layer of an electrophotographic photoreceptor containing metal oxide particles and a binder resin, wherein the metal oxide particles are dispersed using a medium having an average particle diameter of 5 to 200 μm in a wet agitating ball mill; and the metal oxide particles have a cumulative volume average diameter D50 of 0.1 μm or less and a volume particle size distribution width index SD satisfying the following Expression (1) which are measured by a dynamic light-scattering method in the coating liquid for forming an undercoat layer, $$0.010 \leqq SD \leqq 0.040 \quad (1)$$

wherein SD=(D84−D16)/2, wherein D84 represents the particle diameter (μm) at a point of 84% in the cumulative volume particle size distribution curve, and D16 represents the particle diameter (μm) at a point of 16% in the cumulative volume particle size distribution curve; and particle size distribution is accumulated from the smaller particle size side.

4. The method for preparing a coating liquid for forming an undercoat layer of an electrophotographic photoreceptor according to claim 3, wherein the SD satisfies the following Expression (2):

$$0.020 \leqq SD \leqq 0.030 \quad (2).$$

5. The method for preparing a coating liquid for forming an undercoat layer of an electrophotographic photoreceptor according to claim 3, wherein the wet agitating ball mill comprises a cylindrical stator, a slurry-supplying port disposed at one end of the stator, a slurry-discharging port disposed at the other end of the stator, a rotor for agitating and mixing a medium packed in the stator and a slurry supplied from the supplying port, a separator that is rotatably connected to the discharging port and separates the medium and the slurry by centrifugal force to discharge the slurry from the discharging port, and a shaft serving as a rotary shaft of the separator; wherein a center of the shaft has a hollow discharging path communicating with the discharging port.

6. The method for preparing a coating liquid for forming an undercoat layer of an electrophotographic photoreceptor according to claim 3, wherein the wet agitating ball mill comprises a cylindrical stator, a slurry-supplying port disposed at one end of the stator, a slurry-discharging port disposed at the other end of the stator, a rotor for agitating and mixing a medium packed in the stator and a slurry supplied from the supplying port, wherein a separator that is rotatably disposed in the stator so as to be connected to the discharging port and separates the medium and the slurry by centrifugal force to discharge the slurry from the discharging port; and the separator comprises two disks having blade-fitting grooves on the inner faces facing each other, a blade fitted to the fitting grooves and lying between the disks, and supporting means supporting the disks having the blade therebetween from both sides.

7. The method for preparing a coating liquid for forming an undercoat layer of an electrophotographic photoreceptor according to claim 3, wherein the medium has an average particle diameter of 10 to 100 μm.

8. An electrophotographic photoreceptor including an undercoat layer containing a binder resin and metal oxide particles on an electroconductive support, and a photosensitive layer disposed on the undercoat layer, wherein the metal oxide particles have a cumulative volume average diameter D50' of 0.1 μm or less and a volume particle size distribution width index SD' satisfying the following Expression (3) which are measured by a dynamic light-scattering method in a liquid containing the undercoat layer dispersed in a solvent mixture of methanol and 1-propanol at a weight ratio of 7:3, $$0.010 \leqq SD' \leqq 0.040 \quad (3)$$

wherein SD'=(D84'−D16')/2, wherein D84' represents the particle diameter (μm) at a point of 84% in the cumulative volume particle size distribution curve, and D16' represents the particle diameter (μm) at a point of 16% in the cumulative volume particle size distribution curve; and particle size distribution is accumulated from the smaller particle size side.

9. The electrophotographic photoreceptor according to claim 8, wherein the SD' satisfies the following Expression (4):

$$0.020 \leqq SD' \leqq 0.030 \quad (4).$$

10. An image-forming apparatus including an electrophotographic photoreceptor, charging means for charging the electrophotographic photoreceptor, image exposure means for forming an electrostatic latent image by subjecting the charged electrophotographic photoreceptor to image exposure, development means for developing the electrostatic latent image with toner, and transfer means for transferring the toner to a transfer object, wherein the electrophotographic photoreceptor comprises an undercoat layer containing a binder resin and metal oxide particles on an electroconductive support, and a photosensitive layer disposed on the undercoat layer; and the metal oxide particles have a cumulative volume average diameter D50' of 0.1 μm or less and a volume particle size distribution width index SD' satisfying the following Expression (3) which are measured by a dynamic light-scattering method in a liquid containing the undercoat layer dispersed in a solvent mixture of methanol and 1-propanol at a weight ratio of 7:3, $$0.010 \leqq SD' \leqq 0.040 \quad (3)$$

wherein SD'=(D84'−D16')/2, wherein D84' represents the particle diameter (μm) at a point of 84% in the cumulative volume particle size distribution curve, and D16' represents the particle diameter (μm) at a point of 16% in the cumulative volume particle size distribution curve; and particle size distribution is accumulated from the smaller particle size side.

11. The image-forming apparatus according to claim 10, wherein the SD' satisfies the following Expression (4):

$$0.020 \leqq SD' \leqq 0.030 \quad (4).$$

12. The image-forming apparatus according to claim 10, wherein the charging means is configured to come into contact with the electrophotographic photoreceptor.

13. The image-forming apparatus according to claim 10, wherein the image exposure means uses light having a wavelength of 350 to 600 nm.

14. An electrophotographic cartridge including an electrophotographic photoreceptor and at least one of charging means for charging the electrophotographic photoreceptor, image exposure means for forming an electrostatic latent image by subjecting the charged electrophotographic photoreceptor to image exposure, development means for developing the electrostatic latent image with toner, transfer means for transferring the toner to a transfer object, fixing means for fixing the toner transferred to the transfer object, and cleaning means for recovering the toner adhering to the electrophotographic photoreceptor, wherein the electrophotographic photoreceptor comprises an undercoat layer containing a binder resin and metal oxide particles on an electroconductive support, and a photosensitive layer disposed on the undercoat layer; and the metal oxide particles have a cumulative volume average diameter D50' of 0.1 μor less and a volume particle size distribution width index SD' satisfying the following Expression (3) which are measured by a dynamic light-scattering method in a liquid containing the undercoat layer dispersed in a solvent mixture of methanol and 1-propanol at a weight ratio of 7:3, $$0.010 \leqq SD' \leqq 0.040 \quad (3)$$

wherein SD'=(D84'−D16')/2, wherein D84' represents the particle diameter (μm) at a point of 84% in the cumulative volume particle size distribution curve, and D16' represents the particle diameter (μm) at a point of 16% in the cumulative volume particle size distribution curve; and particle size distribution is accumulated from the smaller particle size side.

15. The electrophotographic cartridge according to claim 14, wherein the SD' satisfies the following Expression (4):

$$0.020 \leqq SD' \leqq 0.030 \quad (4).$$

16. The electrophotographic cartridge according to claim 14, wherein the charging means is configured to come into contact with the electrophotographic photoreceptor.

* * * * *